US009975344B2

(12) United States Patent
Hiratsuka et al.

(10) Patent No.: US 9,975,344 B2
(45) Date of Patent: May 22, 2018

(54) WIPING DEVICE AND EJECTING DEVICE

(71) Applicant: FUJI XEROX CO., LTD., Tokyo (JP)

(72) Inventors: Masashi Hiratsuka, Kanagawa (JP); Atsumichi Imazeki, Kanagawa (JP); Yuichi Inoue, Kanagawa (JP); Masaki Kataoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days. days.

(21) Appl. No.: 15/466,945

(22) Filed: Mar. 23, 2017

(65) Prior Publication Data

US 2018/0079217 A1 Mar. 22, 2018

(30) Foreign Application Priority Data

Sep. 21, 2016 (JP) ..... 2016-184325

(51) Int. Cl.
*B41J 2/165* (2006.01)

(52) U.S. Cl.
CPC ..... *B41J 2/16535* (2013.01)

(58) Field of Classification Search
CPC ..... B41J 2/16535; B41J 2/16538; B41J 2/16541; B41J 2/16544; B41J 2/16547; B41J 2/16505; B41J 2/16552; B41J 2002/1655; B41J 2002/16558
See application file for complete search history.

(56) References Cited

U.S. PATENT DOCUMENTS

2008/0158291 A1* 7/2008 Satake ..... B41J 2/16535 347/33
2013/0100216 A1 4/2013 Ohnishi
2014/0085376 A1* 3/2014 Kato ..... B41J 2/16552 347/33

FOREIGN PATENT DOCUMENTS

| | | |
|---|---|---|
| JP | 11-198359 | 7/1999 |
| JP | 2000-272107 | 10/2000 |
| JP | 2001-347651 | 12/2001 |
| JP | 2007-118481 | 5/2007 |
| JP | 2007-331116 | 12/2007 |
| JP | 2013-67087 | 4/2013 |
| JP | 2014-46528 | 3/2014 |
| JP | 2016-68422 | 5/2016 |
| WO | 2011/111689 | 9/2011 |

OTHER PUBLICATIONS

Office Action dated Jan. 31, 2017 in corresponding Japanese Patent Application No. 2016-184325.

(Continued)

*Primary Examiner* — Juanita D Jackson
(74) *Attorney, Agent, or Firm* — Fildes & Outland, P.C.

(57) ABSTRACT

Provided is a wiping device including: an impregnated member that is impregnated with a liquid, has a contact surface having lengths which are longer than that of a nozzle-formed surface in a longitudinal direction and in a transverse direction intersecting with the longitudinal direction of the nozzle-formed surface of an ejecting head that ejects an ejection liquid, and causes the contact surface to come into contact with the nozzle-formed surface such that the nozzle-formed surface is wetted; and a wiping member that wipes the nozzle-formed surface wetted by the impregnated member.

9 Claims, 20 Drawing Sheets

(56) References Cited

OTHER PUBLICATIONS

English language translation of Office Action dated Jan. 31, 2017 in corresponding Japanese Patent Application No. 2016-184325.
Abstract and machine translation of JP 2016-68422.
Abstract and machine translation of JP 2000-272107.
Abstract and machine translation of JP 2001-347651.
Abstract and machine translation of JP 2007-118481.
Abstract and machine translation of JP 2007-331116.
English language abstract of JP 2013-67087.
Abstract and machine translation of JP 2014-46528.
Abstract and machine translation of JP 11-198359.

* cited by examiner

WIPING DEVICE AND EJECTING DEVICE

CROSS REFERENCE TO RELATED APPLICATION

This application is based on and claims priority under 35 USC 119 from Japanese Patent Application No. 2016-184325 filed on Sep. 21, 2016.

BACKGROUND

Technical Field

The present invention relates to a wiping device and an ejecting device.

SUMMARY

An object of the invention is to remove attached matter attached on a side surface of an ejecting head.

According to an aspect of the invention, there is provided a wiping device including an impregnated member and a wiping member. The impregnated member is impregnated with a liquid. The impregnation member has a contact surface. The contact surface has a first length and a second length. The first length is longer than a length of a nozzle-formed surface of an ejecting head in a longitudinal direction. The second length is longer than a length of a nozzle-formed surface in a transverse direction intersecting with the longitudinal direction of the nozzle-formed surface. The nozzle-formed surface ejects an ejection liquid. The impregnated member causes the contact surface to contact with the nozzle-formed surface and wet the nozzle-formed surface. The wiping member wipes the nozzle-formed surface wetted by the impregnated member.

BRIEF DESCRIPTION OF THE DRAWINGS

Exemplary embodiment(s) of the present invention will be described in detail based on the following figures, wherein.

DETAILED DESCRIPTION

Hereinafter, an example of an exemplary embodiment according to the invention will be described with reference to the figures.

(Image Forming Apparatus 10)

Figure 1:
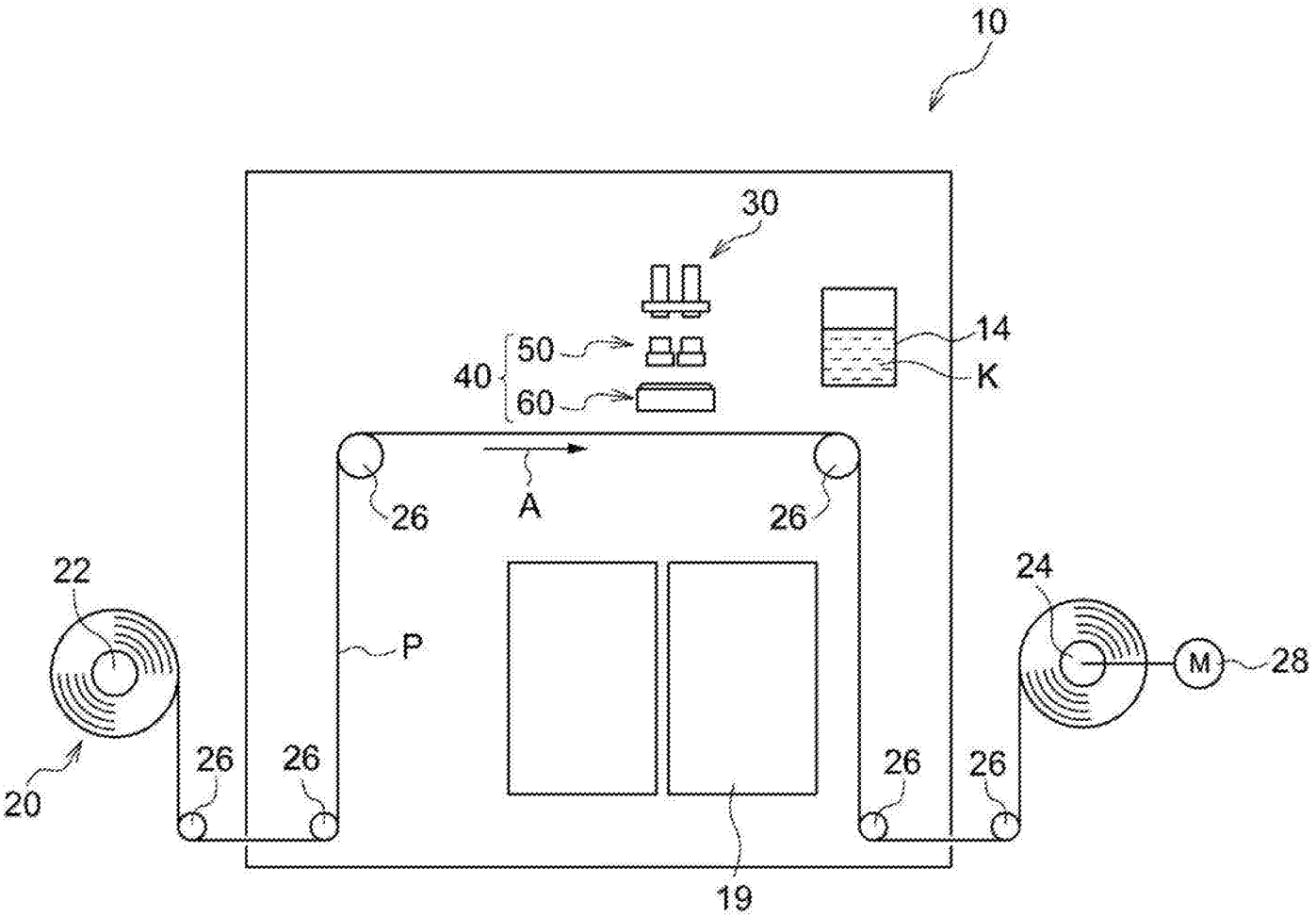
FIG. 1 is a diagram schematically illustrating a configuration of an image forming apparatus according to the exemplary embodiment.

First, the image forming apparatus 10 (an example of an ejecting device) is described. FIG. 1 is a diagram schematically illustrating a configuration of an image forming apparatus 10.

The image forming apparatus 10 ejects ink droplets to continuous paper P (an example of a recording medium) which is long in a transport direction and forms an image on the continuous paper P so as to function as an example of an ejecting device that ejects ink droplets. Specifically, as illustrated in FIG. 1, the image forming apparatus 10 includes a transport mechanism 20, an ejecting unit 30, a wiping device 40, and a controller 19.

(Transport Mechanism 20)

The transport mechanism 20 transports the continuous paper P. Specifically, as illustrated in FIG. 1, the transport mechanism 20 includes an unwinding roller 22 that unwinds the continuous paper P, a winding roller 24 that winds the continuous paper P, and plural transport rollers 26 that transport the continuous paper P. The winding roller 24 is driven to rotate by a driving unit 28. In this manner, the winding roller 24 winds the continuous paper P and the unwinding roller 22 unwinds the continuous paper P.

The continuous paper P extends over the plural transport rollers 26 between the unwinding roller 22 and the winding roller 24. In this manner, a transporting path of the continuous paper P is defined from the unwinding roller 22 to the winding roller 24. The winding roller 24 winds the continuous paper P, and thereby the plural transport rollers 26 are driven to rotate with the continuous paper P that moves forward to the winding roller 24 side. Note that, in the figures, the transport direction of the continuous paper P (hereinafter, simply referred to as the "transport direction" in some cases) is appropriately represented by arrow A.

(Ejecting Unit 30)

The ejecting unit 30 ejects ink droplets to the continuous paper P. The ejecting unit 30 has a length in a width direction of the continuous paper P (an intersecting direction intersecting with the transport direction of the continuous paper P). In other words, a direction parallel to the width direction of the continuous paper P is a longitudinal direction of the ejecting unit 30 (hereinafter, referred to as simply a longitudinal direction in some cases), and a direction parallel to the transport direction of the continuous paper P is a transverse direction of the ejecting unit 30 (hereinafter, referred to as simply a transverse direction in some cases). Note that, in FIG. 2, the longitudinal direction of the ejecting unit 30 is represented by an arrow X direction, and the transverse direction of the ejecting unit 30 is represented by an arrow Y direction.

Figure 2:
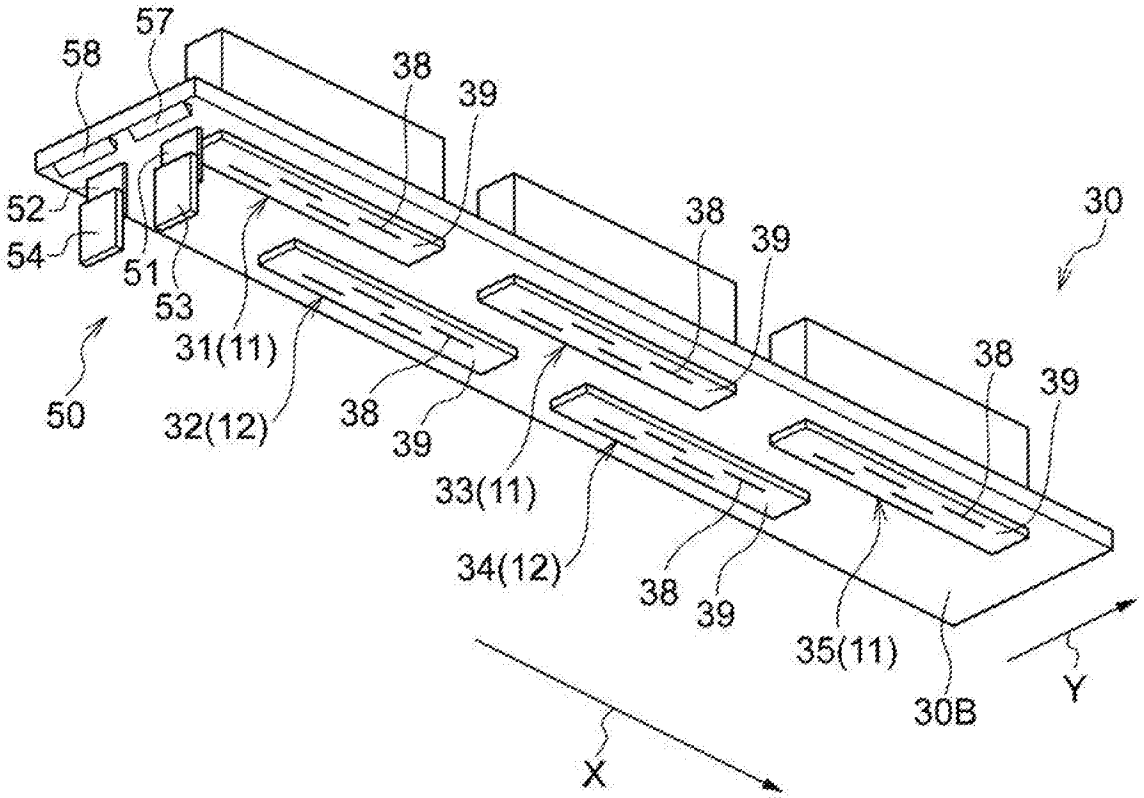
FIG. 2 is a perspective view illustrating a configuration of an ejecting unit according to the exemplary embodiment.

As illustrated in FIG. 2, the ejecting unit 30 includes plural (specifically, five) ejecting heads 31, 32, 33, 34, and 35 (hereinafter, described as 31 to 35). The ejecting heads 31 to 35 have a rectangular shape with a length in the longitudinal direction of the ejecting unit 30 in a bottom-face view. The ejecting heads 31 to 35 are disposed to form a zigzag pattern in this order in the longitudinal direction of the ejecting unit 30. In other words, the ejecting unit 30 has a first head row 11 formed to include the ejecting heads 31, 33, and 35 which are disposed in the longitudinal direction, and a second head row 12 formed to include the ejecting heads 32 and 34 which are disposed in the longitudinal direction. The first head row 11 and the second head row 12 are adjacent to each other in the transverse direction.

The ejecting heads 31 to 35 are connected, via a tube (pipe) (not illustrated), to a storage unit 14 (refer to FIG. 1) which stores the ink (art example of an ejection liquid). Ink is supplied to the ejecting heads 31 to 35 from the storage unit 14.

In addition, the ejecting heads 31 to 35 have a nozzle-formed surface 39 in which plural nozzles 38 are formed. Note that FIG. 2 illustrates plural nozzles 38 in a simplified manner. The ejecting heads 33 to 35 are provided with drive systems (drive circuits), respectively, the drive systems are driven, and ink droplets are ejected from the nozzles 38 of the nozzle-formed surface 39. Note that a water repellent membrane is formed on the nozzle-formed surface 39 except for forming portion of the nozzles 38 (holes) by water repellent finishing.

Note that plural ejecting units 30 may be provided for colors of yellow (Y), magenta (M), cyan (C), and black (K), respectively.

(Operation of Ejecting Unit 30)

In the exemplary embodiment, the ejecting unit 30 is configured to be movable in an up-down direction by a moving mechanism 37 (refer to FIG. 3) using mechanism elements such as a ball screw or a belt. Specifically, the ejecting unit 30 is movable, as an example, between a standby position illustrated in FIG. 3, a wiping position illustrated in FIG. 4, a pressure purging position illustrated in FIG. 5, a capping position illustrated in FIG. 6, a wetting position illustrated in FIG. 7, and an image forming position (printing position) illustrated in FIG. 8. For example, the standby position, the wiping position, the pressure purging position, the capping position, a wetting position, and an image forming position are set to have heights which are lowered in the up-down direction in this order.

At the wiping position illustrated in FIG. 4, the wiping operation is performed on the ejecting unit 30, in which a pair of wipers 51 and 52, which will described below, of a wiping mechanism 50 wipes the nozzle-formed surfaces 39, respectively. Note that the specific wiping operation will be described below.

Figure 5:
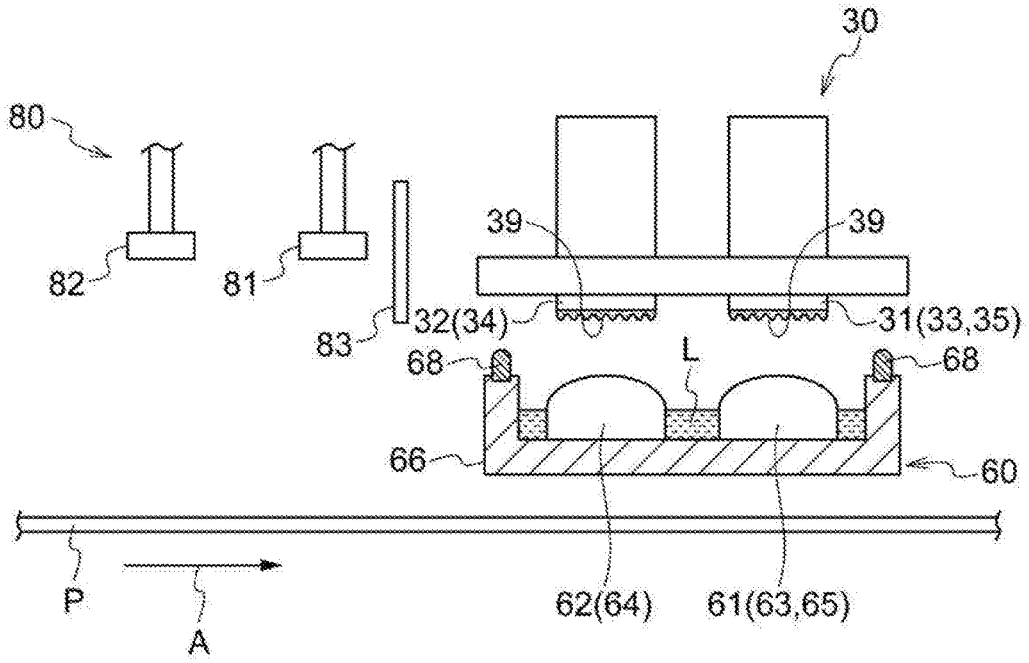
FIG. 5 is a diagram schematically illustrating a state in which the ejecting unit is positioned at a pressure purging position in the configuration in FIG. 3.

At the pressure purging position illustrated in FIG. 5, the following pressure purging operation is performed on the ejecting unit 30. In the pressure purging operation, a pressure pump (not illustrated) connected to the storage unit 14 (refer to FIG. 1) pressurizes the inside of the storage unit 14, and thereby ink exits from the nozzles 38 of the ejecting heads 31 to 35 to a cap member 66 which will be described below such that bubbles or thickened ink in the nozzles 33 is removed. Note that the periphery of the nozzles 38 in the nozzle-formed surface 39 is wet with ink through the pressure purging operation.

In addition, at the pressure purging position illustrated in FIG. 5, the ejecting unit 30 drives the drive systems of the ejecting heads 31 to 35, and thereby the ink is ejected from the nozzles 38 to the cap member 66 which will be described below such that a dummy jet operation of removing bubbles or thickened ink in the nozzles 38 is performed.

Figure 6:
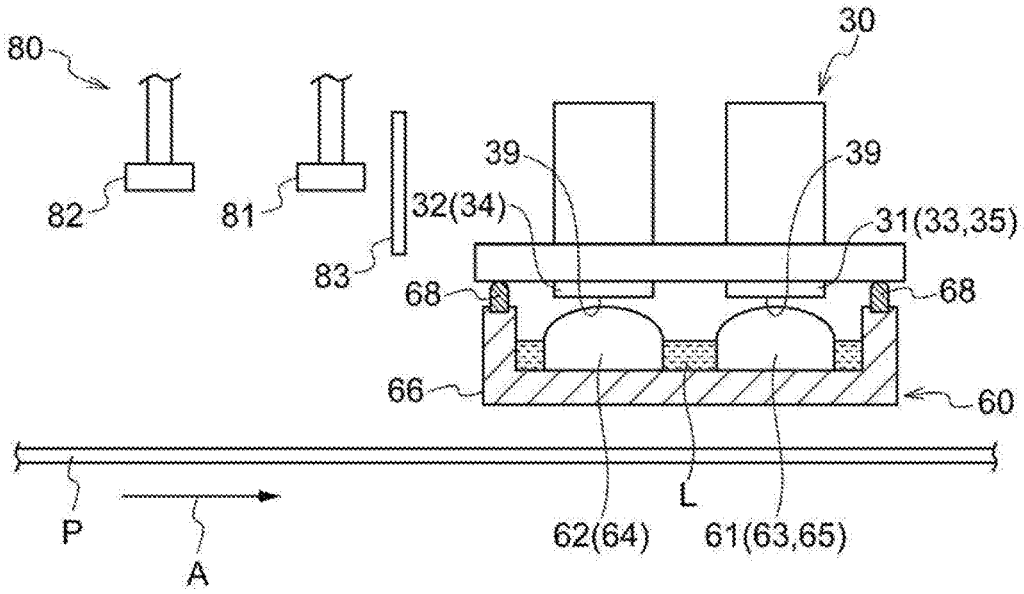
FIG. 6 is a diagram schematically illustrating a state in which the ejecting unit is positioned at a cap position in the configuration in FIG. 3.

In addition, at the capping position illustrated in FIG. 6, the capping operation is performed on the ejecting unit 30, in which the cap member 66, which will be described below, of a cap mechanism 60 covers a bottom surface 30B of the ejecting unit 30.

In addition, at the wetting position illustrated in FIG. 7, a wetting operation is performed on the ejecting unit 30, in which pads 61 to 65, which will be described below, of the cap mechanism 60 wet the nozzle-formed surface 39. Note that the specific wetting operation will be described below.

Figure 8:
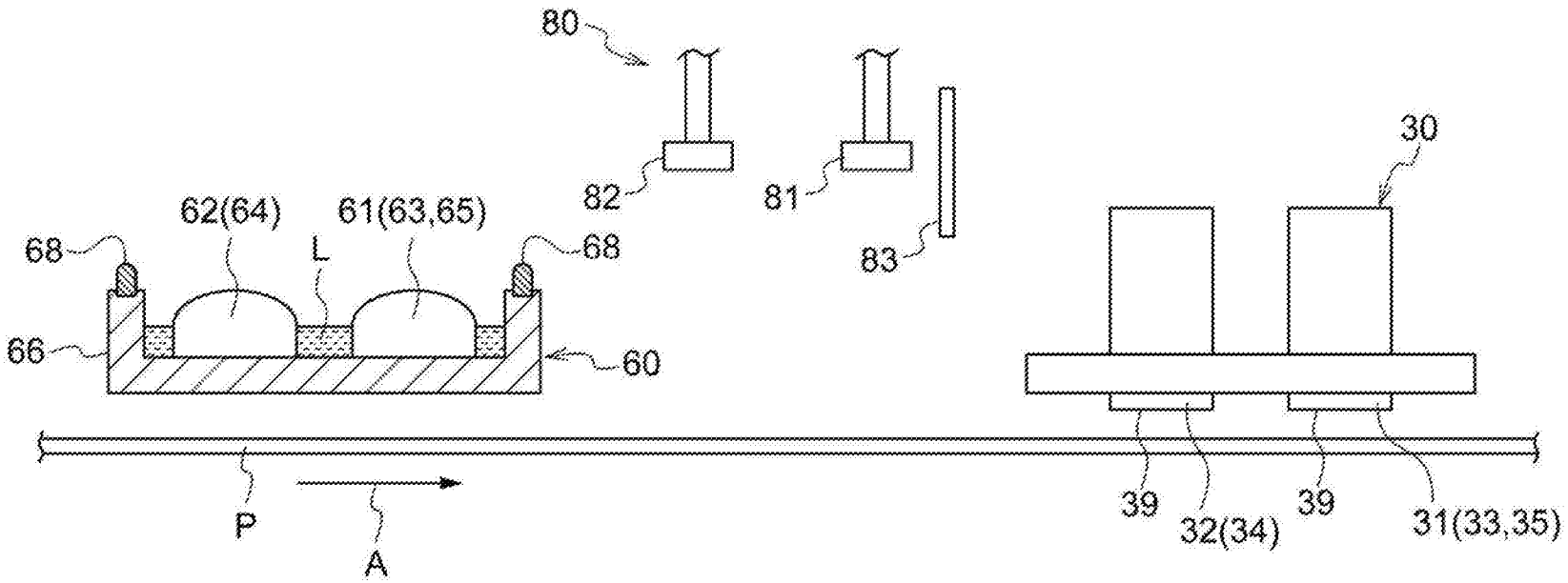
FIG. 8 is a diagram schematically illustrating a state in which the ejecting unit is positioned at an image forming position in the configuration in FIG. 3.

In addition, at the image forming position illustrated in FIG. 8, the ejecting unit 30 drives the drive systems of the ejecting heads 31 to 35, and thereby ink droplets are ejected from the nozzles 38 to the continuous paper P such that an image forming operation of forming an image on the continuous paper P is performed. At the image forming position, the nozzle-formed surfaces 39 of the ejecting heads 31 to 35 are positioned below a liquid level in the storage unit 14. Thus, appropriate ink back pressure is applied to the ejecting heads 31 to 35 in the image forming operation due to a water head difference occurring when the liquid level in the storage unit 14 is lowered below the nozzle-formed surface 39.

Note that the storage unit 14 moves in the up-down direction by a moving mechanism (not illustrated), and height relationships between the liquid level in the storage unit 14 and the nozzle-formed surfaces 39 of the ejecting heads 31 to 35 are adjusted depending on the positions of the ejecting unit 30.

Specifically, in a state in which the ejecting unit 30 is positioned at the wetting position (refer to FIG. 7), the height of the liquid level in the storage unit 14 with respect to the nozzle-formed surface 39 is higher than the height at the image forming position (refer to FIG. 8). As described above, the water head difference is adjusted, and thereby the back pressure applied to supply the ink to the ejecting heads 31 to 35 is higher during the wetting operation than during the image forming operation.

In addition, in a state in which the ejecting unit 30 is positioned at the wiping position (refer to FIG. 6), the height of the liquid level in the storage unit 14 with respect to the nozzle-formed surface 39 is lower than the height at the wetting position (refer to FIG. 7), and is higher than the height at the image forming position (refer to FIG. 8). As described above, the water head difference is adjusted, and thereby the back pressure applied to supply the ink to the ejecting heads 31 to 35 during the wiping operation is higher than during the image forming operation, and is lower than during the wetting operation.

Note that, in the ejecting unit 30, at the standby position (refer to FIG. 3), at the pressure purging position (refer to FIG. 5), and at the capping position (refer to FIG. 6), height relationships between the liquid level in the storage unit 14 and the nozzle-formed surfaces 39 of the ejecting heads 31 to 35 are the same as the height relationship at the image forming position.

(Wiping Device 40)

Figure 3:
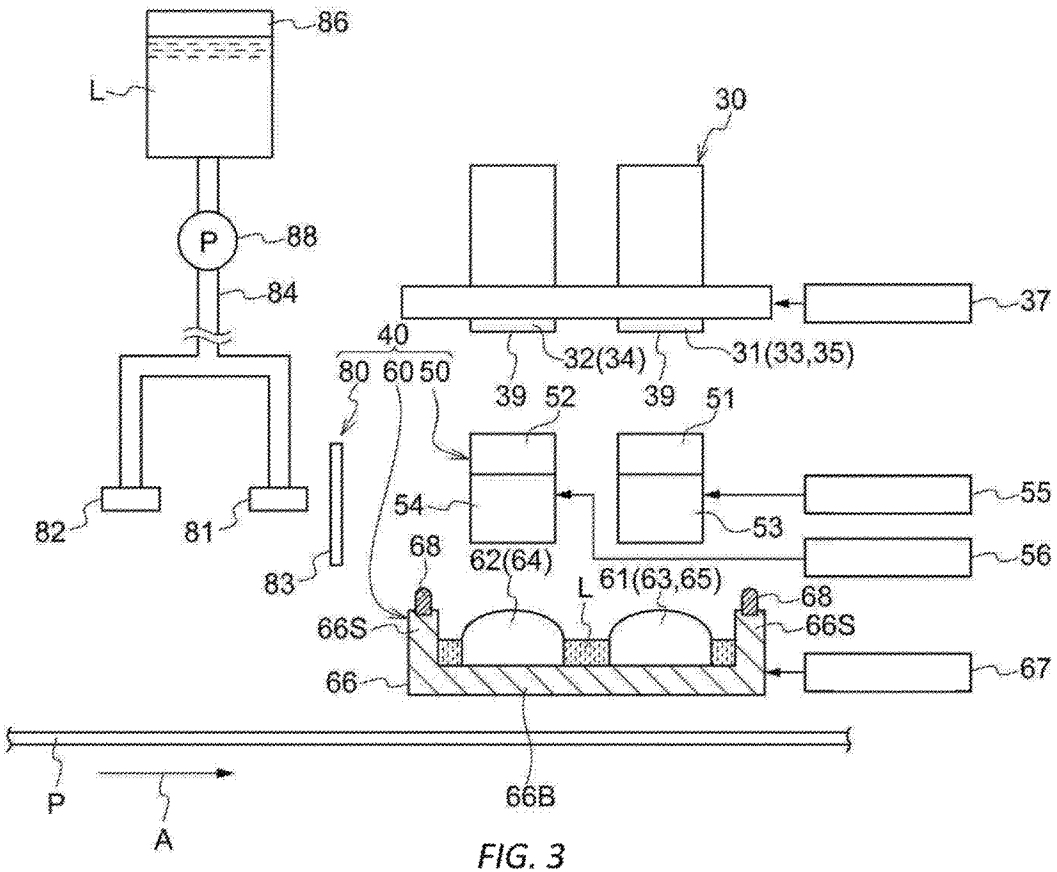
FIG. 3 is a diagram schematically illustrating a configuration of the ejecting unit and a wiping device according to the exemplary embodiment.

As illustrated in FIG. 3, the wiping device 40 includes a wiping mechanism 50 (wiping mechanism), a cap mechanism 60 (covering mechanism), and a cleaning-liquid supply mechanism 80.

(Wiping Mechanism 50)

The wiping mechanism 50 wipes the nozzle-formed surfaces 39 of the ejecting heads 31 to 35. Specifically, as illustrated in FIGS. 2 and 3, the wiping mechanism 50 includes a pair of wipers 51 and 52 (an example of a wiping member), a pair of support members 53 and 54, a pair of moving mechanisms 55 and 56 (refer to FIG. 3), and a pair of removing members 57 and 58 (refer to FIG. 2).

Figure 4:
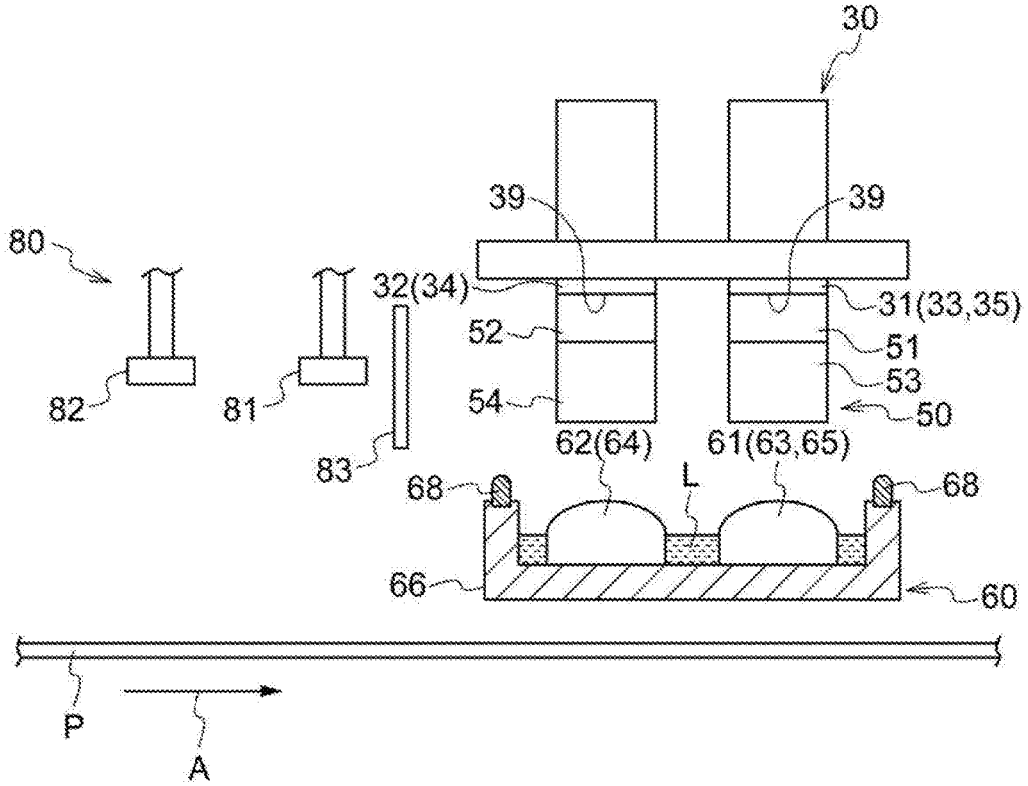
FIG. 4 is a diagram schematically illustrating a state in which the ejecting unit is positioned at a wiping position in the configuration in FIG. 3.

The wipers 51 and 52 are supported by the support members 53 and 54 so as to project upward from the support members 53 and 54, respectively, at a position at which the wipers is able to come into contact with the nozzle-formed surfaces 39 of the ejecting unit 30 and the removing members 57 and 58 which are positioned at the wiping position (refer to FIG. 4).

The removing members 57 and 58 remove foreign matter such as ink attached to the wipers 51 and 52. The removing members 57 and 58 are disposed on one end side of each of the ejecting head 31 and the ejecting head 32 in the longitudinal direction.

(Operation of Wipers 51 and 52)

The wipers 51 and 52 are individually and independently actuated by the moving mechanisms 55 and 56, respectively, via the support members 53 and 54. Specifically, the moving mechanisms 55 and 56 cause the support members 53 and 54 to move in the longitudinal direction of the ejecting unit 30, and cause the wipers 51 and 52 to move in the longitudinal direction of the ejecting unit 30, using a mechanical element such as a ball screw or a belt.

The wiper 51 moves in the longitudinal direction of the ejecting unit 30 in a contact state with the nozzle-formed surfaces 39 of the ejecting heads 31, 33, and 35 chat configure the first head row 11, thereby wiping the nozzle-formed surfaces 39. The wiper 52 moves in the longitudinal direction of the ejecting unit 30 in a contact state with the nozzle-formed surfaces 39 of the ejecting heads 32 and 34 that configure the second head row 12, thereby wiping the nozzle-formed surfaces 39.

Note that the wiping operations of the wipers 51 and 52 are performed after the pads 61 to 65, which will be described below, or the cap mechanism 60 wet the nozzle-formed surfaces 39 of the ejecting heads 31 to 35, respectively. In other words, the wipers 51 and 52 wipe the nozzle-formed surfaces 39 wetted by the pads 61 to 65 which will be described below.

In addition, the wipers 51 and 52 move in the longitudinal direction of the ejecting unit 30 in a contact state with the removing members 57 and 58, and thereby the removing members 57 and 58 scrape and remove foreign matter such as ink attached to the wipers 51 and 52.

In addition, the moving mechanisms 55 and 56 cause the wipers 51 and 52 to move toward one end side (front side of the paper surface in FIG. 3) of the ejecting unit 30 in the longitudinal direction in an unused state, and the wipers are on standby at this position. Note that states in which the wipers 51 and 52 are not used include cases of performing operations (for example, the pressure purging operation, the capping operation, the wetting operation, the image forming operation, the dummy jet operation, or the like) other than the wiping operation.

(Cap Mechanism 60)

Figure 10:
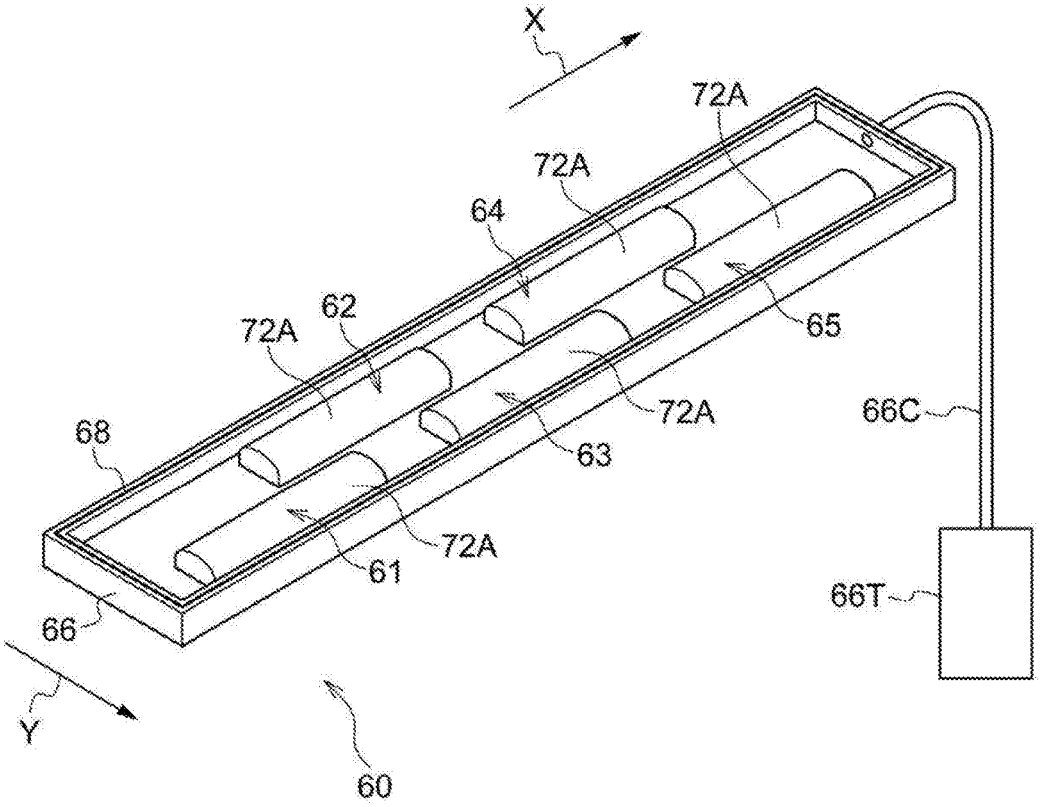
FIG. 10 is a perspective view illustrating a configuration of the cap member according to the exemplary embodiment.

The cap mechanism 60 performs covering (capping) of the bottom surface 30B of the ejecting unit 30. Specifically, as illustrated in FIGS. 3 and 10, the cap mechanism 60 includes the cap member 66, a rib 68, and plural (specifically, five) pads 61, 62, 63, 64, and 65 (hereinafter, described as 61 to 65).

The cap member 66 has a bottom wall 66B and a side wall 66S having a frame shape in a plan view and has an opened upper side. As illustrated in FIG. 3, the rib 68 is disposed on the top surface of the side wall 66S and has a frame shape in the plan view as illustrated in FIG. 10. The rib 68 is formed of an elastic member such as rubber.

A predetermined amount of cleaning liquid L is contained inside the cap member 66, that is, on the bottom wall 66B. The cleaning liquid L is a liquid that can redissolve a thickened or solidified ink. Specifically, as an example, a solvent contained in the ink is used as the cleaning liquid. Note that it is desirable that a liquid having surface tension lower than that of ink is used as the cleaning liquid such that wettability of the nozzle-formed surface 39 is improved.

The cap member 66 also functions as a reception member that receives the ink ejected from the ejecting heads 31 to 35 during the pressure purging operation and the dummy jet operation described above. The ink exiting to the cap member 66 during the pressure purging operation and the dummy jet operation is contained in the cap member 66 and functions as the cleaning liquid L.

Note that one end portion of a tube 66C (exit tube) is connected to the side wall 66S of the cap member 66, and the other end portion of the tube 66C is connected to a waste tank 66T. When an amount of the cleaning liquid L (including the ink exiting during the pressure purging operation and the dummy jet operation, the same in the following description) contained inside the cap member 66 exceeds the predetermined amount, the cleaning liquid is caused to exit to the waste tank 66T through the tube 66C.

(Pads 61 to 65)

Figure 7:
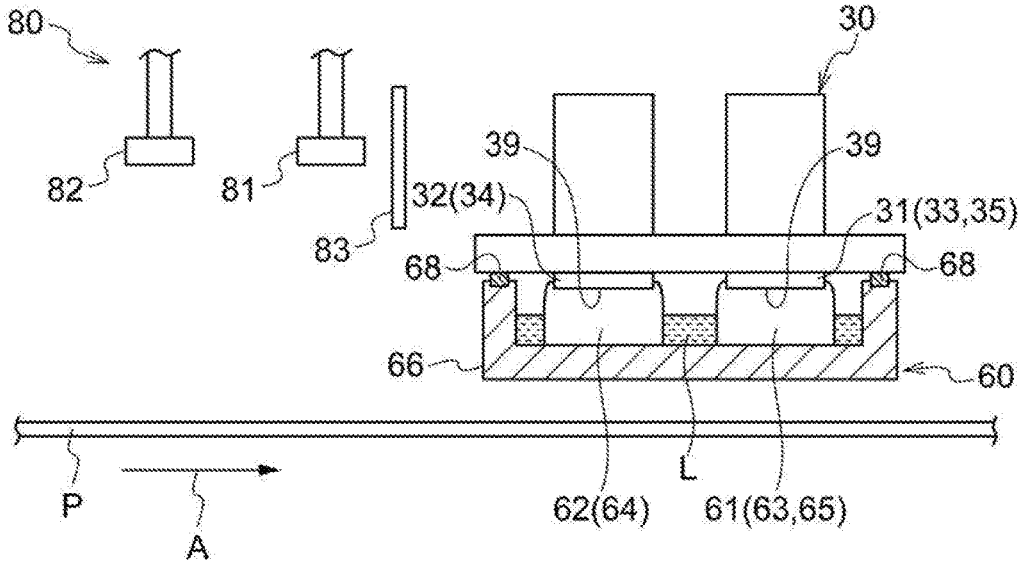
FIG. 7 is a diagram schematically illustrating a state in which the ejecting unit is positioned at a wetting position in the configuration in FIG. 3.

The pads 61 to 65 function as an example of an impregnated member that is impregnated with the cleaning liquid L (an example of a liquid) and comes into contact with the nozzle-formed surfaces 39 of the ejecting heads 31 to 35 so as to wet the nozzle-formed surfaces 39 (refer to FIG. 7).

Specifically, as illustrated in FIG. 10, the pads 61 to 65 are disposed inside the cap member 66, that is, on an inner side of the side wall 66S of the cap member 66 in the plan view and on the bottom wall 66B. Further, the pads 61 to 65 are provided at positions corresponding to the ejecting heads 31 to 35. In other words, the pads 61 to 65 are disposed at positions facing the ejecting heads 31 to 35 in states in which the cap member 66 is positioned at operation positions illustrated in FIGS. 3 to 7 described below.

Figure 11A:
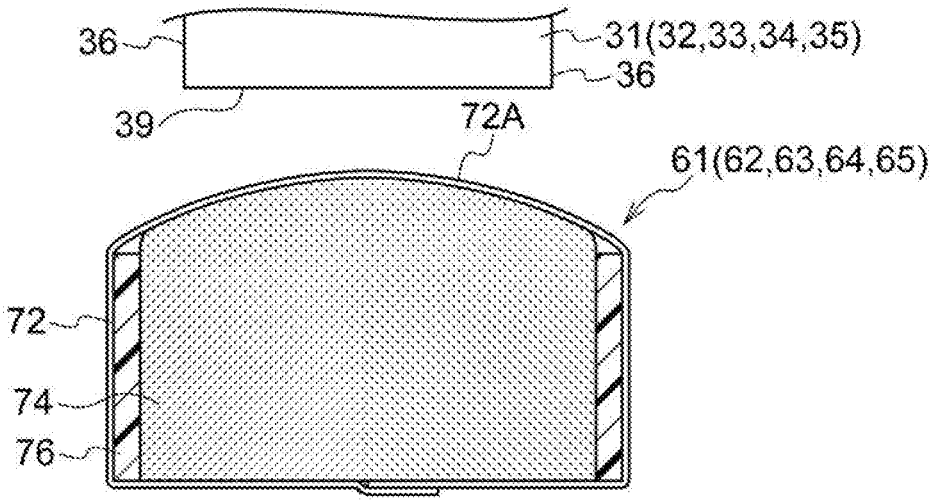
FIGS. 11A and 11B are sectional front views illustrating a configuration of a pad according to the exemplary embodiment.

The pads 61 to 65 have a rectangular shape with a length in the longitudinal direction of the ejecting unit 30 in the plan view. Specifically, the pads 61 to 65 have a cloth member 72, a porous member 74, and an accommodating member 76, as illustrated in FIG. 11A.

The accommodating member 76 is formed to have an elongated frame shape which is opened in the up-down direction. For example, the accommodating member 76 is formed of a resin material and has stiffness higher than that of the cloth member 72 and the porous member 74.

The porous member 74 is accommodated inside the accommodating member 76 so as to have the upper portion that projects upward from the accommodating member 76. For example, a porous member (specifically, flexible urethane foam or the like) having a sponge shape with elasticity is used as the porous member 74. The porous member 74 is formed to have a hog-backed shape in which the porous member bulges upward to form a convex shape at the central portion in the transverse direction in the upper portion which projects upward from the accommodating member 76 such that the maximum bulging is obtained.

For example, polyester cloth (specifically, trade name: AS pure super wiper (manufactured by AS ONE Corporation)) having a low dust producing property is used as the cloth member 72. The cloth member 72 covers the top surface of the porous member 74 and an outer side surface of the accommodating member 76 and has end portions which are fixed to each other on the underside of the porous member 74.

A lower portion of the cloth member 12 and a lower portion of the porous member 74 are immersed in the cleaning liquid contained inside the cap member 66, and the pads 61 to 65 are impregnated with the cleaning liquid. In this manner, the pads 61 to 65 hold the cleaning liquid.

Figure 11B:
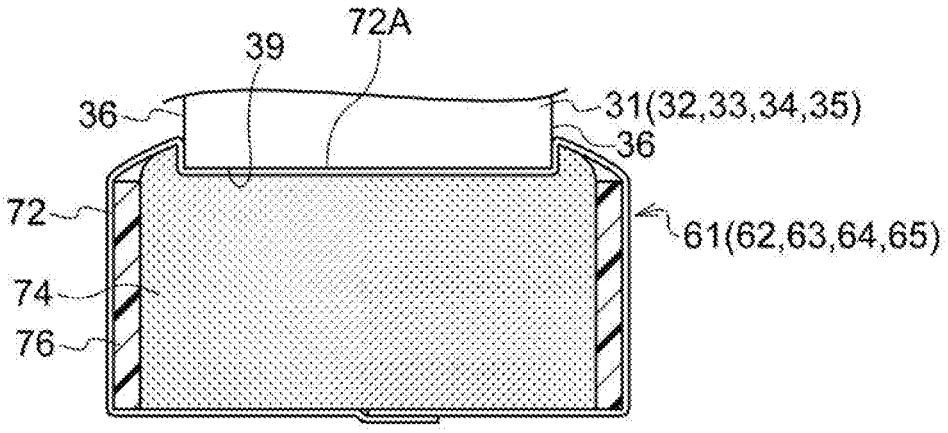

As illustrated in FIG. 11B, the top surface (an example of a front surface) of the cloth member 72 of the pads 61 to 65 configures contact surfaces 72A that come into contact with the nozzle-formed surfaces 39 of the ejecting heads 31 to 35, respectively. The porous member 74 is disposed on the backside with respect to the contact surface 72A of the cloth member 72. Hence, the nozzle-formed surfaces 39 of the ejecting heads 31 to 35 do not come into contact with the porous member 74.

Note that the cloth member 72 covers the porous member 74 that bulges upward to have a convex shape at the central portion in the transverse direction, and thereby the pads 61 to 65 bulge upward to have a convex shape at the central portion in the transverse direction on the contact surface 72A.

Figure 11C:
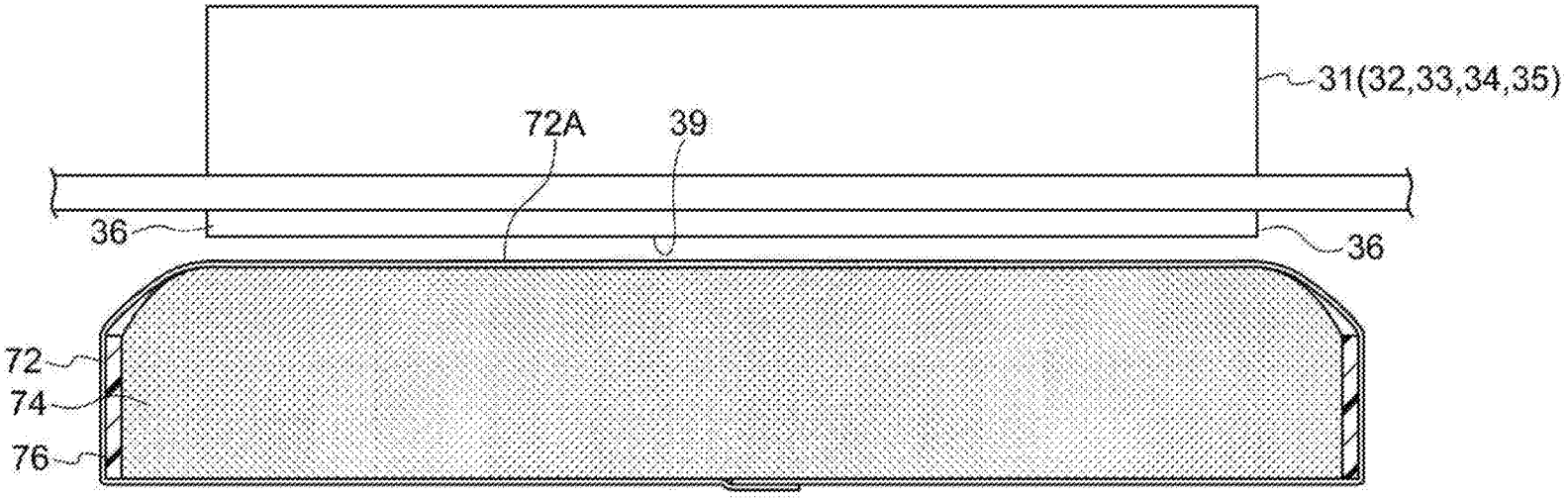
FIG. 11C is a sectional side view illustrating the configuration of the pad according to the exemplary embodiment.

Further, as illustrated in FIGS. 11A to 11C, the contact surfaces 72A of the pads 61 to 65 have lengths longer than those of the nozzle-formed surface 39 in the longitudinal direction and the transverse direction of the nozzle-formed surface 39. In a state in which the pads 61 to 65 face the ejecting heads 31 to 35, respectively, the nozzle-formed surfaces 39 of the ejecting heads 31 to 35 are arranged on the inner side of the four corners (outer edges) of the pads 63 to 65 in the plan view.

(Operation of Cap Member 66)

Figure 9:
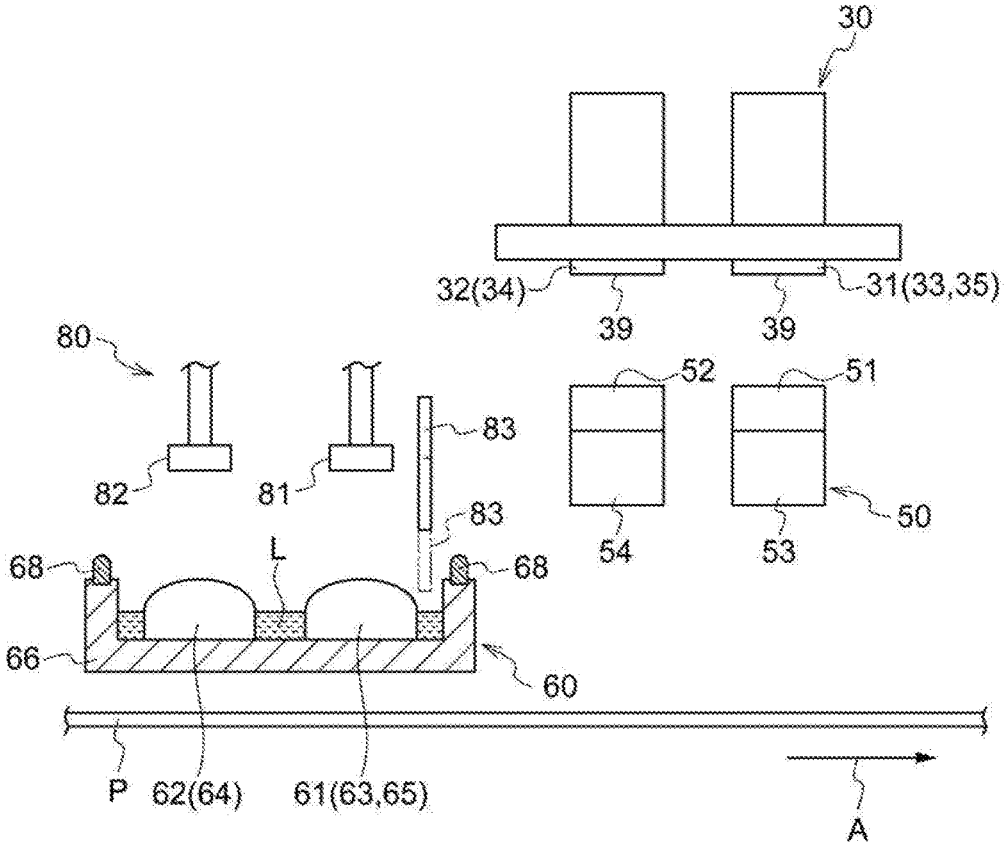
FIG. 9 is a diagram schematically illustrating a state in which a cap member is positioned in a supply region in the configuration in FIG. 3.

The cap member 66 is configured to be movable in a transport direction A of the continuous paper P by a moving mechanism 67 (refer to FIG. 3) using mechanism elements such as a ball screw or a belt. Specifically, the cap member 66 is movable between an operation position illustrated in FIGS. 3 to 7 and a retracted position illustrated in FIG. 6. Further, as illustrated in FIG. 9, the cap member 66 has a supply region set between the operation position illustrated in FIGS. 3 to 7 and the retracted position illustrated in FIG. 8, in which the cleaning liquid is supplied from the cleaning-liquid supply mechanism 80 during the movement between the operation position and the retracted position.

In a state in which the cap member 66 is positioned in the operation position (refer to FIG. 3), the ejecting unit 30 is lowered from the standby position (refer to FIG. 3) and moves to the capping position (refer to FIG. 6), and thereby the rib 68 comes into contact with the bottom surface 30B of the ejecting unit 30 so as to surround the ejecting heads 31 to 35 in the plan view. In this manner, the cap member 66 covers the bottom surface 30B of the ejecting unit 30 in a sealing state (the capping operation).

In the state in which cap member 66 covers the bottom surface 30B of the ejecting unit 30, humidity inside the cap member 66 is maintained with the cleaning liquid L contained inside the cap member 66. In this manner, the nozzles 38 of the ejecting heads 31 to 35 are less dried. Note that, at this time, a gap is formed between the pads 61 to 65 and the nozzle-formed surfaces 39 of the ejecting heads 31 to 35 as illustrated in FIG. 6 so as not to come into contact with the nozzle-formed surfaces 39.

Further, the ejecting unit 30 moves from the capping position (refer to FIG. 6) to the wetting position (refer to FIG. 7), and thereby the rib 68 is compressed and the nozzle-formed surfaces 39 of the ejecting heads 31 to 35 are pushed against the contact surfaces 72A.

In this manner, the contact surfaces 72A are brought into contact with the nozzle-formed surfaces 39 of the ejecting heads 31 to 35 and wet the nozzle-formed surfaces 39 with the cleaning liquid (wetting operation).

The nozzle-formed surfaces 39 are wetted with the cleaning liquid, and thereby ink fixed to the nozzle-formed surface 39 is redissolved. In addition, the contact surface 72A are brought into contact with the nozzle-formed surfaces 39, and thereby the redissolved ink or solid matter (unmelted matter) such as paper dust attached to the nozzle-formed surface 39 is attached to the contact surface 72A and is removed.

Figure 18A:
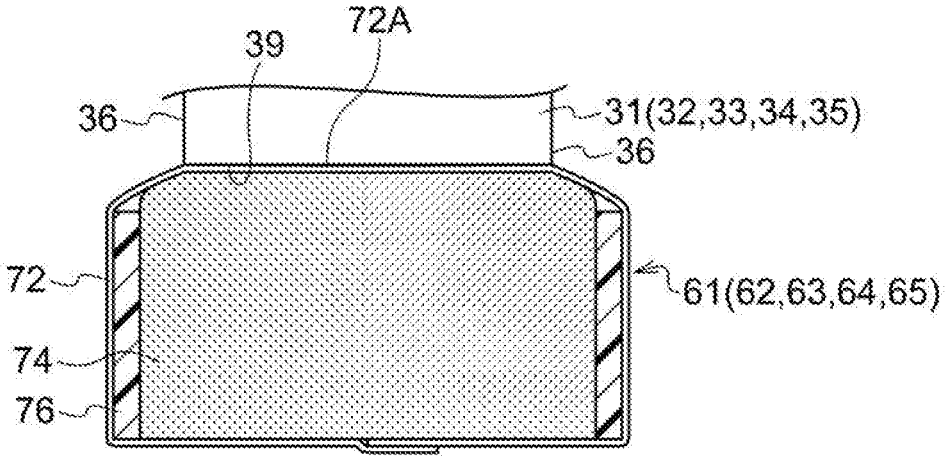
FIG. 18A is a sectional front view illustrating a state in which a pad comes into contact with an entire nozzle-formed surface.

Note that the moving mechanism 37 (refer to FIG. 3) is capable of perform fine adjustment on a position of the wetting position (refer to FIG. 7) of the ejecting unit 30 in the up-down direction. In this manner, a pushing amount of the ejecting heads 31 to 35 against the pads 61 to 65 changes, and thus it is possible to change a contact range of the pads 61 to 65 with the ejecting heads 31 to 35. Specifically, for example, it is possible to change a contact range (refer to FIG. 18A) in which the pads 61 to 65 are brought into contact with the nozzle-formed surfaces 39 of the ejecting heads 31 to 35 and a contact range (refer to FIG. 11B) in which the pads 61 to 65 are brought into contact with the nozzle-formed surfaces 39 and side surfaces 36 of the ejecting heads 31 to 35. Note that the nozzle-formed surfaces 39 are caused to come into contact with the pads 61 to 65 such that the ejecting heads 31 to 35 are embedded in the pads 61 to 65, and thereby the pads 61 to 65 are brought into contact with the nozzle-formed surfaces 39 and the side surfaces 36 of the ejecting heads 31 to 35.

In addition, the contact range of the pads 61 to 65 with the nozzle-formed surface 39 may be changed in such a configuration.

Figure 18B:
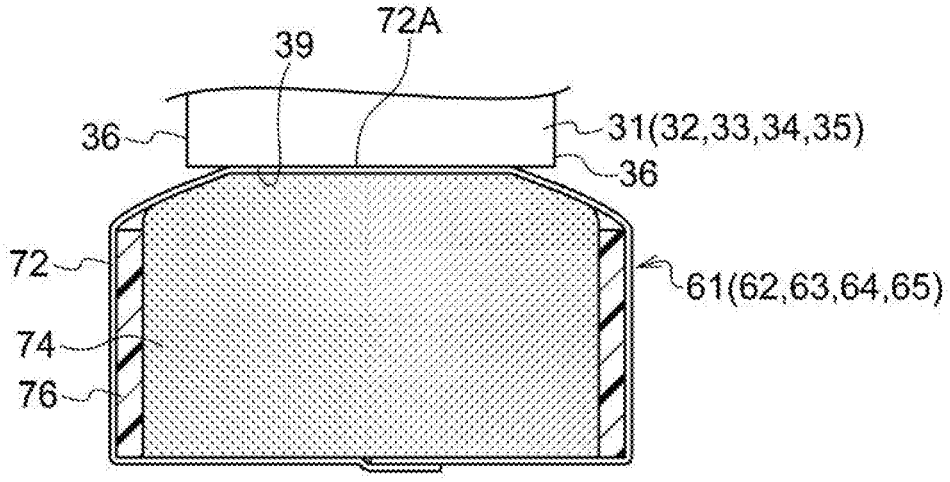
FIG. 18B is a sectional front view illustrating a state in which the pad comes into contact with a part of the nozzle-formed surface, in the configuration in FIG. 11.

For example, it is possible to change the contact range (refer to FIG. 18A) in which the pads 61 to 65 are brought into contact with the entire nozzle-formed surfaces 39 and a contact range (refer to FIG. 18B) in which the pads 61 to 65 are brought into contact with a part of the nozzle-formed surfaces 39.

In addition, it is possible to adjust a period of contact time of the pads 61 to 65 with the nozzle-formed surfaces 39 of the ejecting heads 31 to 35. For example, the period of contact time and the contact range described above of the pads 61 to 65 are adjusted in accordance with actuation history (stained conditions of the nozzle-formed surfaces 39) of the ejecting heads 31 to 35. The actuation history of the ejecting heads 31 to 35 is defined by a transport length of the continuous paper P (a length of the continuous paper P on which an image is formed), a period of image forming time, or image density.

(Cleaning-Liquid Supply Mechanism 80)

The cleaning-liquid supply mechanism 80 supplies the cleaning liquid L to the pads 61 to 66 in a dropping manner. Specifically, as illustrated in FIG. 3, the cleaning-liquid supply mechanism 80 includes supply heads 81 and 82 (an example of a supply unit), a circulation tube 84, a tank 86, a pump 88, and a blade 83 (an example of the wiping member for an impregnated member).

The supply heads 81 and 82 are disposed above the pads 61, 63, and 65, and the pads 62 and 64 of the cap member 66, respectively, in a state of being positioned in the supply region illustrated in FIG. 9.

Figure 12:
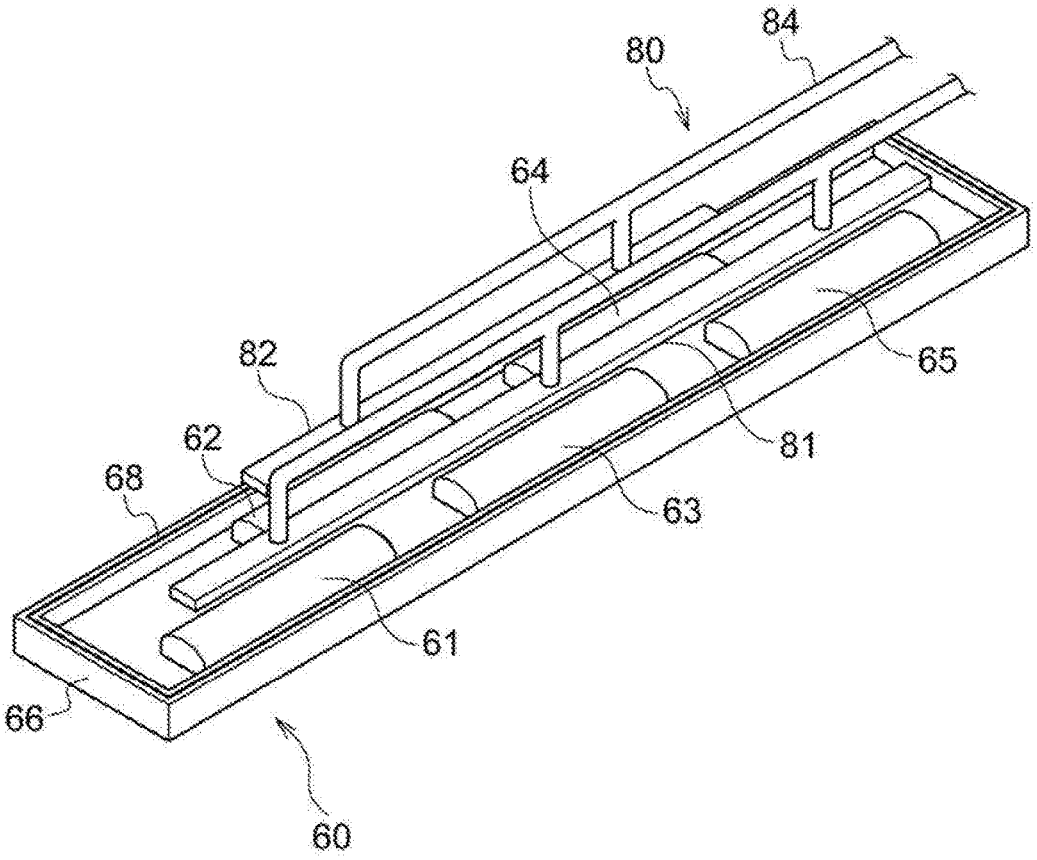
FIG. 12 is a perspective view illustrating a configuration of a cleaning-liquid supply mechanism according to the exemplary embodiment.
Figure 13C:
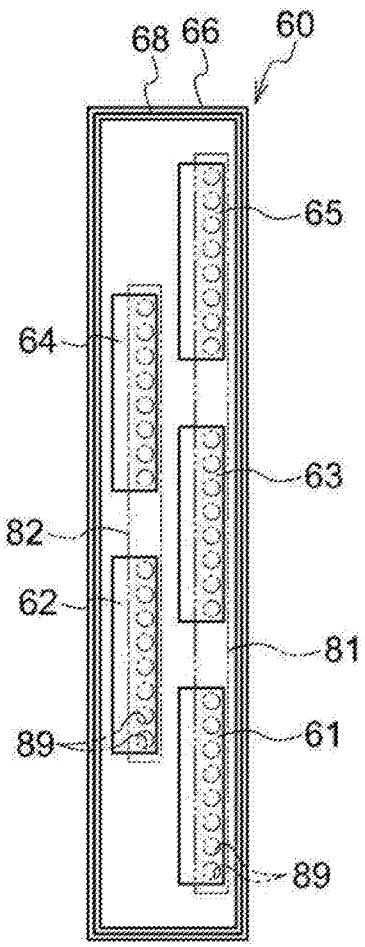
FIGS. 13A to 13C are plan views illustrating a supply operation of a cleaning liquid in the cleaning-liquid supply mechanism according to the exemplary embodiment.
Figure 13B:
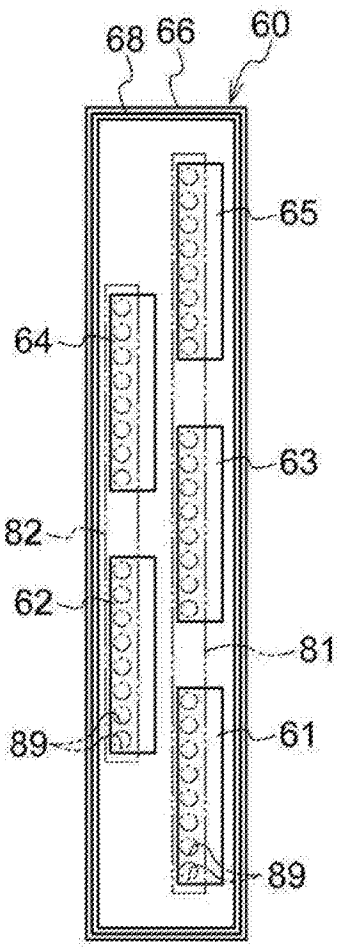

As illustrated in FIG. 12, the supply heads 81 and 82 have a length in the longitudinal direction of the ejecting unit 30. As illustrated in FIGS. 13B and 13C, the supply heads 81 and 82 are provided with nozzles 89 facing the pads 61 to 65, respectively. The supply heads 81 and 82 drop the cleaning liquid L to the pads 61 to 65 from the nozzles 89.

The tank 86 functions as a container that contains the cleaning liquid L that is sent the supply heads 81 and 82. The circulation tube 84 has one end portion that is connected to the tank 86 and the other end side that is divided into plural branches which are connected to the supply heads 81 and 32, respectively.

The pump 88 is provided in the circulation tube 84 and the pump 88 is driven. In this manner, the cleaning liquid L is sent to the supply heads 81 and 82 from the tank 86 and the cleaning liquid L is dropped to the pads 61 to 65 from the nozzles 89 of the supply heads 81 and 82. In the cleaning-liquid supply mechanism 80, the pump 88 is controlled to be driven, and thereby it is possible to change a supply amount of the cleaning liquid L to the pads 61 to 65.

The blade 83 is formed to extend in the up-down direction and to have a plate shape with a thickness in the transport direction A. The blade 83 has a length in the longitudinal direction of the ejecting unit 30.

In addition, as illustrated in FIG. 9, the blade 83 is disposed on the ejecting unit 30 side (right side in FIG. 9) with respect to the supply head 81. The blade 83 is disposed between the supply heads 81 and 82 and the ejecting unit 30 in the transport direction A (horizontal direction) of the continuous paper P.

In addition, a moving mechanism (not illustrated) causes the blade 83 to move between a contact position (position illustrated in a two-dot chain line) at which the blade can come into contact with the contact surfaces 72A of the pads 61 to 65 and a retracted position (position illustrated in a solid line) at which the blade is retracted from the cap member 66.

At the contact position, the blade 83 wipes the pads 61 to 65, with the cap member 66 moving from the supply region illustrated in FIG. 9 to the operation position illustrated in FIGS. 3 to 7. As described above, the blade 83 functions as the wiping member that wipes the contact surfaces 72A of the pads 61 to 65.

(Controller 19)

The controller 19 controls elements of the image forming apparatus 10, specifically, the transport mechanism 20, elements of the ejecting unit 30, the wiping device 40, and the like. The controller 19 controls the elements of the ejecting unit 30 and the wiping device 40, thereby performing operations (a dummy jet operation, a pressure purging operation, a wetting operation, a wiping operation, or the like) in a maintenance operation and other operations. Hereinafter, specific operations of the maintenance operation will be described.

(Maintenance Operation)

Examples of various types of maintenance operations performed in the image forming apparatus 10 are described. For example, in the image forming apparatus 10, the following first, second, third, and fourth maintenance operations are performed.

In the first maintenance operation, drive systems of the ejecting heads 31 to 35 are driven such that the dummy jet operation, in which ink is ejected from the nozzles 33 of the ejecting heads 31 to 35 to the cap member 66, is performed.

In the second maintenance operation, the wetting operation in which the pads 61 to 65 are brought into contact with the nozzle-formed surfaces 39 of the ejecting heads 31 to 35 so as to wet the nozzle-formed surfaces 39, the wiping operation in which the wipers 51 and 52 wipe the nozzle-formed surfaces 35 wetted in the wetting operation, and the dummy jet operation are performed in this order.

In the third maintenance operation, the wetting operation, the pressure purging operation in which a storage unit 14 has a high pressure inside, and thereby ink is discharged from the nozzles 38 of is the ejecting heads 31 to 35 to the cap member 66, the wiping operation, and the dummy jet operation are performed in this order.

In the fourth maintenance operation, the same operations as those in the third maintenance operation are performed. However, in the wetting operation in the fourth maintenance operation, the contact range of the pads 61 to 65 with the nozzle-formed surfaces 39 of the ejecting heads 31 to 35 is broader than that in the third maintenance operation. For example, the third maintenance operation has the contact range in which the pads 61 to 65 are brought into contact with only the nozzle-formed surfaces 39 of the ejecting heads 31 to 35, and the fourth maintenance operation has the contact range in which the pads 61 to 65 are brought into contact with the nozzle-formed surfaces 39 and the side surfaces 36 of the ejecting heads 31 to 35. Note that, in addition to or instead of broadening the contact range with the nozzle-formed surfaces 39, the period of contact time of the pads 61 to 65 with the nozzle-formed surfaces 39 of the ejecting heads 31 to 35 may be increased more than in the third maintenance operation.

Note that in the third and fourth maintenance operations, the wetting operation and the pressure purging operation may be performed in a reversed order.

Restoration properties (restoration strength) of restoring states of the ejecting heads 31 to 35 increase in the order of the first, second, third, and fourth maintenance operations described above. For example, the first, second, third, and fourth maintenance operations are performed in the following cases.

For example, in a capping state in which the cap member 66 covers the bottom surface 30B of the ejecting unit 30, the first maintenance operation is performed before the image forming operation when an image forming command is acquired.

For example, the second maintenance operation is performed when power of the image forming apparatus 10 turns on and the image forming apparatus is activated.

In addition, the second, third, and fourth maintenance operations are performed, for example, corresponding to a period of time taken for the image forming operation after the corresponding image forming operation is ended. Specifically, the second maintenance operation is performed in a case where the period of time taken for the image forming operation is shorter than a predetermined period of first time. The fourth maintenance operation is performed in a case where the period of time taken for the image forming operation is longer than or equal to a predetermined period of second time which is longer than the period of first time. The third maintenance operation is performed in a case where the period of time taken for the image forming operation is longer than or equal to the period of first time and shorter than the period of second time.

In addition, the second, third, and fourth maintenance operations may be regularly performed, based on the transport length of the continuous paper P (a length of the continuous paper P on which an image is formed) or the like, regardless of an end timing of the image forming operation.

(Wetting Operation)

Next, an example of a specific procedure of the wetting operation will be described.

Figure 14:
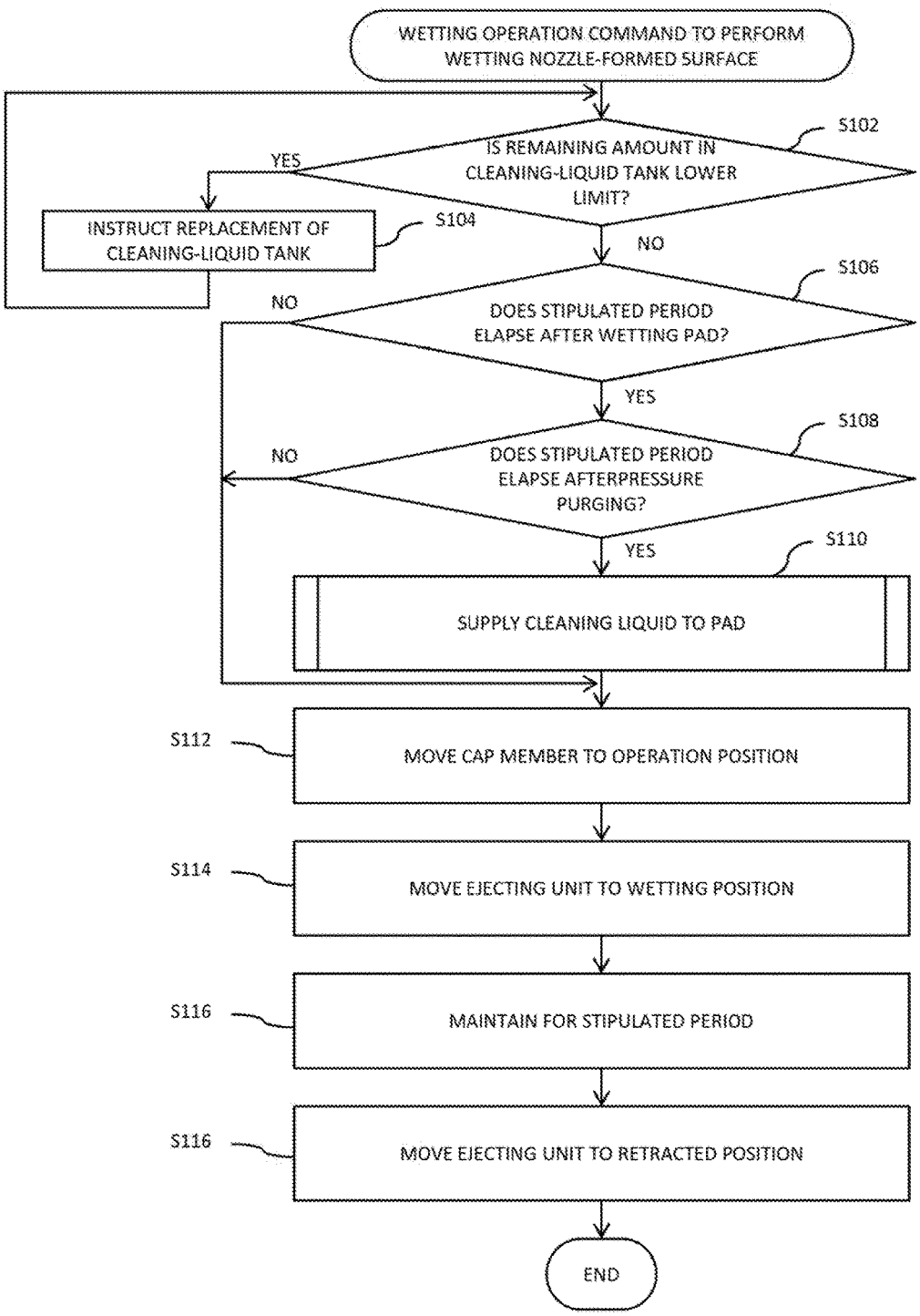
FIG. 14 a flowchart of a wetting operation.

In the exemplary embodiment, when the controller 19 acquires a command to perform wetting on the nozzle-formed surface 39, the following wetting operation is performed (refer to FIG. 14). As illustrated in FIG. 14, when the controller 19 acquires the wetting operation command to perform wetting the nozzle-formed surface 39, the controller determines whether or not a remaining amount of the cleaning liquid L in the tank 86 of the cleaning-liquid supply mechanism 80 is the lower limit (Step 102). In a case where the remaining amount of the cleaning liquid L is the lower limit, a replacement instruction of the tank 86 is notified in Step 104 and the process returns to Step 102. In a case where the remaining amount of the cleaning liquid L is not the lower limit, the process proceeds to Step 106, and the controller determines whether or not a period of elapsed time from the previous supply operation of the cleaning liquid L to the pads 61 to 65 is longer than or equal to a stipulated period of time.

In a case where the period of elapsed time is shorter than the stipulated period of time, the process proceeds to Step 112.

In a case where the period of elapsed time is longer than or equal to the stipulated period of time, the process proceeds to Step 108, and the controller determines whether or not a period of elapsed time from the previous pressure purging operation is longer than or equal to the stipulated period of time. In a case where the period of elapsed time is shorter than the stipulated period of time, the process proceeds to Step 112.

In the case where the period of elapsed time is longer than or equal to the stipulated period of time, the process proceeds to Step 110, and the supply operation of the cleaning liquid L to the pads 61 to 65 is performed.

Figure 13A:
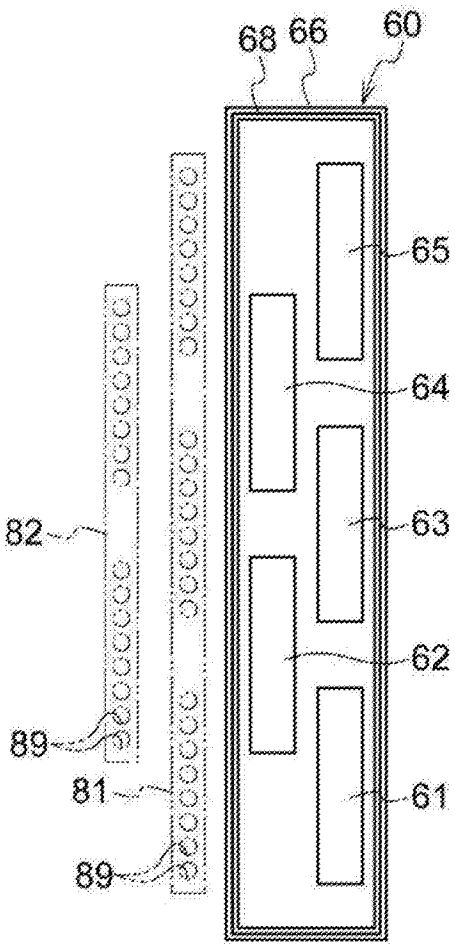

The corresponding supply operation is performed as follows. In other words, the cap member 66 is caused to move, for example, from the operation position illustrated in FIGS. 3 and 13A to the supply region illustrated in FIGS. 9 and 13B. In the supply region, the cap member 66 moves from a position at which the nozzles 89 of the supply heads 81 and 82 face end portions of the pads 61 to 65 in the transverse direction (Y direction) (refer to FIG. 13B) to a position at which the nozzles 89 face the other end portions of the pads 61 to 65 in the transverse direction (Y direction) (refer to FIG. 13C). During the movement, the cleaning liquid L is dropped from the nozzles 89 of the supply heads 81 and 82 to the pads 61 to 65 and the cleaning liquid L is supplied to the pads 61 to 65. As described above, in the supply operation, the cleaning liquid L is supplied to the pads 61 to 65 while the pads 61 to 65 move.

In Step 112, the cap member 66 is caused to move to the operation position (refer to FIG. 3). Next, in Step 114, the ejecting unit 30 is caused to move to the wetting position (refer to FIG. 7) and the nozzle-formed surfaces 39 of the ejecting heads 31 to 35 are pushed against the contact surface 72A. In this manner, the contact surfaces 72A are brought into contact with the nozzle-formed surfaces 39 of the ejecting heads 31 to 35 and wet the nozzle-formed surfaces 39 with the cleaning liquid. At this time, the storage unit 14 moves downward, the height of the liquid level in the storage unit 14 with respect to the nozzle-formed surface 39 is higher than the height at the image forming position (refer to FIG. 8). Hence, the back pressure applied to supply the ink to the ejecting heads 31 to 35 is higher during the wetting operation than during the image forming operation. Note that the pushing amount of the nozzle-formed surface 39 against the contact surface 72A further increases during the wetting operation in the fourth maintenance operation than during the wetting operation in the third maintenance operation.

Next, in Step 116, the ejecting unit 30 maintains a state of being positioned at the wetting position for a predetermined stipulated period of time. Next, in Step 118, the ejecting unit 30 is caused to move to the standby position (refer to FIG. 3) and the wetting operation is ended.

(Cleaning Operation of Contact Surfaces 72A of Pads 61 to 65)

For example, the cleaning operation of the contact surfaces 72A of the pads 61 to 65 is performed after the wetting operation described above is ended.

In the cleaning operation, first, the supply operation of the cleaning liquid L to the pads 61 to 65 is performed.

The corresponding supply operation is performed as follows. In other words, the cap member 66 is caused to move, for example, from the operation position illustrated in FIGS. 3 and 13A to the supply region illustrated in FIGS. 9 and 13B. In the supply region, the cap member 66 moves from a position at which the nozzles 89 of the supply heads 81 and 82 face end portions of the pads 61 to 65 in the transverse direction (Y direction) (refer to FIG. 13B) to a position at which the nozzles 99 face the other end portions of the pads 61 to 65 in the transverse direction (Y direction) (refer to FIG. 13C). During the movement, the cleaning liquid L is dropped from the nozzles 89 of the supply heads 81 and 82 to the pads 61 to 65 and the cleaning liquid h is supplied to the pads 61 to 65. As described above, in the supply operation, the cleaning liquid L is supplied to the pads 61 to 65 while the pads 61 to 65 move.

Note that, in the supply operation, the pump 38 is controlled to be driven, and thereby the supply amount of the cleaning liquid L to the pads 61 to 65 is changed. Specifically, the supply amount is adjusted, for example, in accordance with actuation history (stained conditions of the pads 61 to 65) of the pads 61 to 65. The actuation history of the pads 61 to 65 is defined by the number of times of the wetting operations or the like.

Next, as illustrated in FIG. 9, the blade 83 is caused to move to the contact position (position illustrated in a two-dot chain line) at which the blade can be brought into contact with the contact surfaces 72A of the pads 61 to 65. The cap member 66 is caused to move in the transport direction A of the continuous paper P such that the blade 83 is brought into contact with the pads 61 to 65. In this manner, the blade 83 wipes the contact surfaces 72A of the pads 61 to 65 such that attached matter such as paper dust attached to the contact surfaces 72A is removed.

(Wiping Operation)

Next, an example of a specific procedure of the wiping operation will be described.

Note that, in the wiping operation, as will be described below, first, the nozzle-formed surface 39 of the one ejecting head 31 is wiped, then, the nozzle-formed surfaces 39 of the two ejecting heads 32 and 33 are wiped, and then the nozzle-formed surfaces 39 of the two ejecting heads 35 and 34 are wiped.

Figure 15:
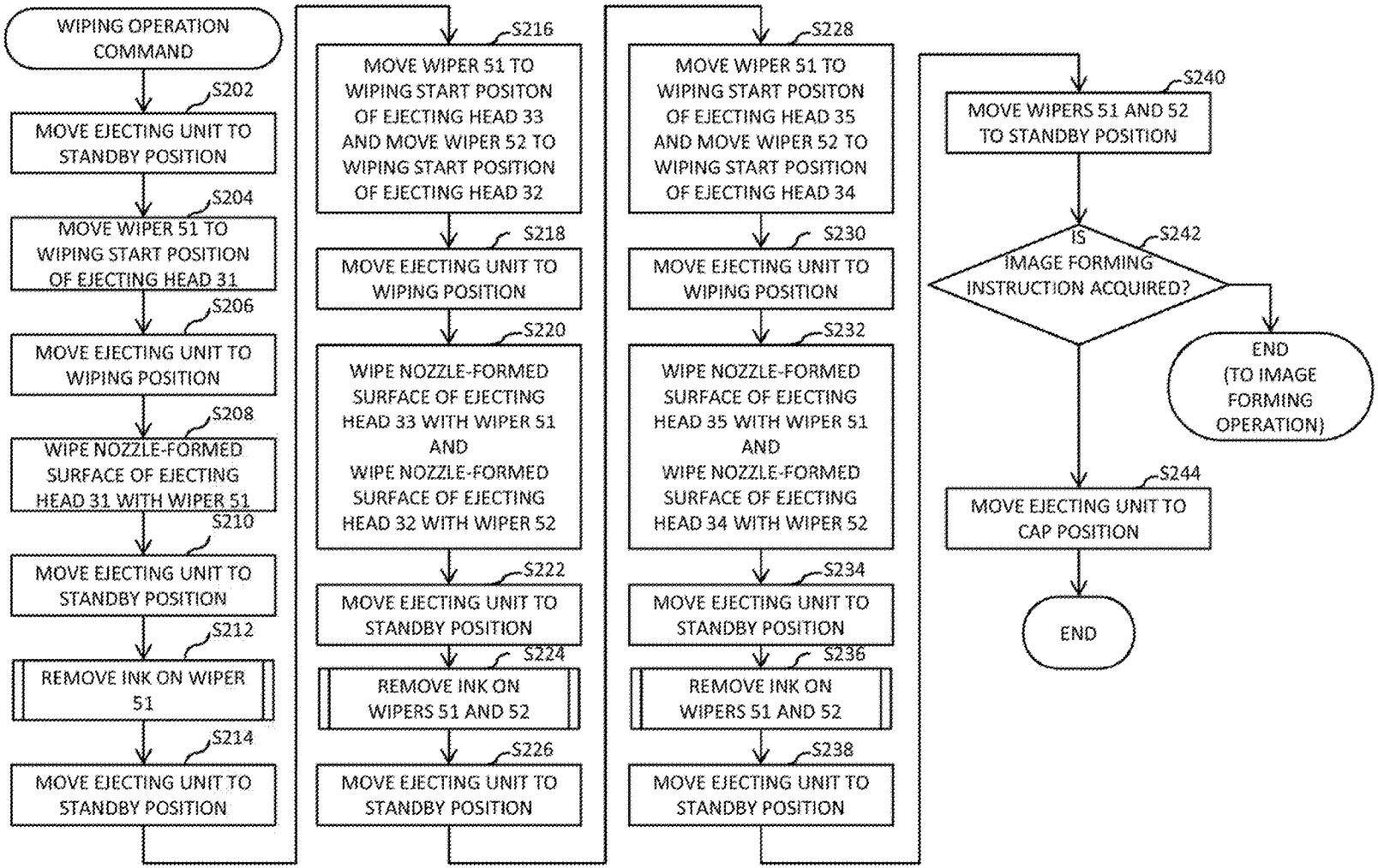
FIG. 15 is a flowchart of a wiping operation.

In the exemplary embodiment, when the controller 19 acquires a wiping-operation performing command, the following wiping operation is performed (refer to FIG. 15). As illustrated in FIG. 15, when the controller 19 acquires the wiping-operation performing command, the ejecting unit 30 is caused to move to the standby position (refer to FIG. 3) (Step 202) .

Figure 16A:
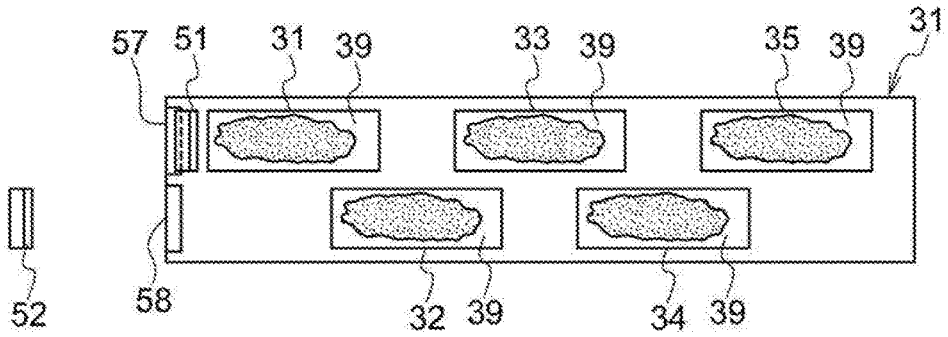
FIGS. 16A to 16C are diagrams schematically illustrating the wiping operation.

Next, in Step 204, the wiper 51 is caused to move to a wiping start position on one end side in the longitudinal direction with respect to the ejecting head 31 (refer to FIG. 16A). At this time wiper 52 is on standby at a standby position on one end side in the longitudinal direction with respect to the ejecting unit 30.

Next, in Step 206, the ejecting unit 30 is caused to move to the wiping position (refer to FIG. 4).

Figure 16B:
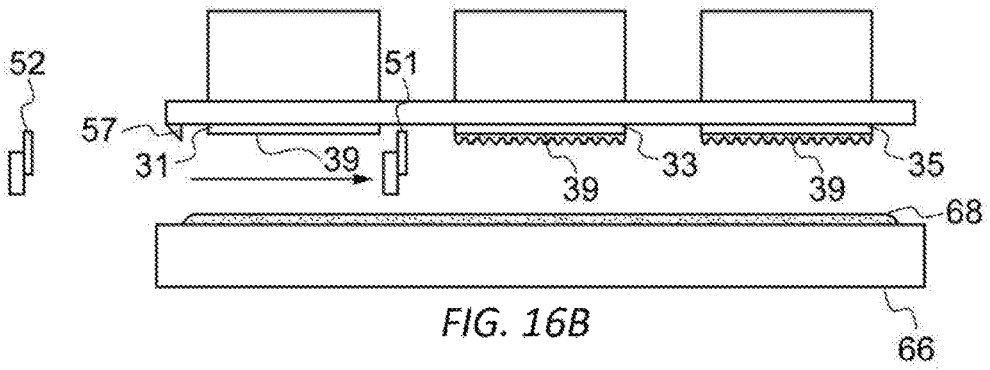

Next, in Step 203, the wiper 51 is caused to move to the other end side in the longitudinal direction with respect to the ejecting head 31 (refer to FIG. 16B). In this manner, the wiper 51 wipes the nozzle-formed surface 39 of the ejecting head 31.

Figure 16C:
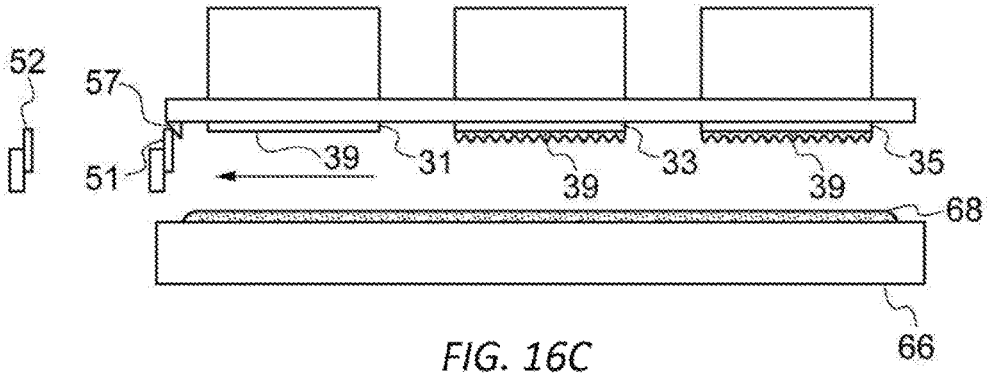

Next, in Step 210, the ejecting unit 30 is caused to move to the standby position (refer to FIG. 3). Next, in Step 212, the removing member 57 performs a removing operation of the ink attached to the wiper 51 (refer to FIG. 16C). In the removing operation, after the wiper 51 is caused to move to the removing member 57, the ejecting unit 30 is caused to move to the wiping position (refer to FIG. 4). The wiper 51 is caused to move such that the wiper 51 comes into contact with the removing member 57, and the ink attached to the wiper 51 is scraped and removed.

Figure 17A:
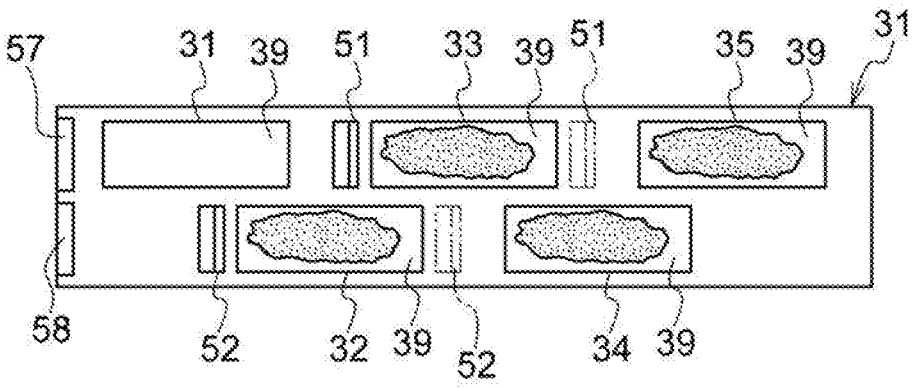
FIGS. 17A and 17B are diagrams schematically illustrating the wiping operation.

Next, in Step 214, the ejecting unit 30 is caused to move to the standby position (refer to FIG. 3). Next, in Step 216, the wiper 51 is caused to move to a wiping start position on one end side in the longitudinal direction with respect to the ejecting head 33, and the wiper 52 is caused to move to a wiping start position on one end side in the longitudinal direction with respect to the ejecting head 32 (refer to FIG. 17A).

Next, in Step 218, the ejecting unit 30 is caused to move to the wiping position (refer to FIG. 4). Next, in Step 220, the wiper 51 is caused to move to the ether end side in the longitudinal direction with respect to the ejecting head 33, and the wiper 52 is caused to move to the other end side in the longitudinal direction with respect, to the ejecting head 32. In this manner, the wiper 51 wipes the nozzle-formed surface 39 of the ejecting head 33, and the wiper 52 wipes the nozzle-formed surface 39 of the ejecting head 32 (refer to a two-dot chain line in FIG. 17A).

Next, in Step 222, the ejecting unit 30 is caused to move to the standby position (refer to FIG. 3). Next, in Step 224, the removing members 57 and 58 perform the removing operations of the ink attached to the wipers 51 and 52. In the removing operation, after the wipers 51 and 52 are caused to move to the removing members 57 and 58, the ejecting unit 30 is caused to move to the wiping position (refer to FIG. 4). The wipers 51 and 52 are caused to move such that the wipers 51 and 52 come into contact with the removing members 57 and 58, and the ink attached to the wipers 51 and 52 is scraped and removed.

Figure 17B:
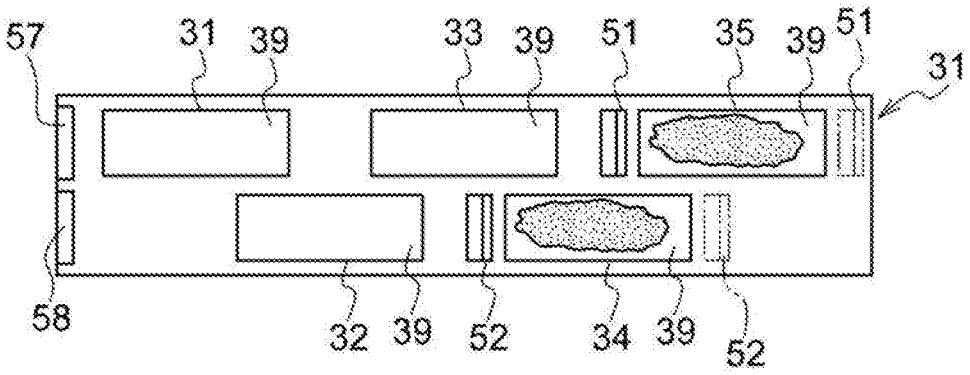

Next, in Step 226, the ejecting unit 30 is caused to move to the standby position (refer to FIG. 3). Next, in Step 228, the wiper 51 is caused to move to a wiping start position on one end side in the longitudinal direction with respect to the ejecting head 35, and the wiper 52 is caused to move to a wiping start position on one end side in the longitudinal direction with respect to the ejecting head 34 (refer to FIG. 17B).

Next, in Step 230, the ejecting unit 30 is caused to move to the wiping position (refer to FIG. 4). Next, in Step 232, the wiper 51 is caused to move to the other end side in the longitudinal direction with respect to the ejecting head 35, and the wiper 52 is caused to move to the other end side in the longitudinal direction with respect to the ejecting head 34. In this manner, the wiper 51 wipes the nozzle-formed surface 39 of the ejecting head 35, and the wiper 52 wipes the nozzle-formed surface 39 of the ejecting head 34 (refer to a two-dot chain line in FIG. 17B).

Next, in Step 234, the ejecting unit 30 is caused to move to the standby position (refer to FIG. 3). Next, in Step 236, the removing members 57 and 58 perform the removing operations of the ink attached to the wipers 51 and 52.

Next, in Step 238, the ejecting unit 30 is caused to move to the standby position (refer to FIG. 3). Next, in Step 240, the wipers 51 and 52 are caused to move to standby positions on one end side in the longitudinal direction with respect to the ejecting unit 30.

Next, in Step 242, in a case where determination of whether the image forming command is acquired is performed and the image forming command is acquired, the wiping operation is ended. In a case where the image forming command is not acquired, the process proceeds to Step 244. Next, in Step 244, the ejecting unit 30 is caused to move to a cap position (refer to FIG. 6). In this manner, the capping operation in which the cap member 66 covers the bottom surface 30B of the ejecting unit 30 is performed.

(Operation of Exemplary Embodiment)

In the exemplary embodiment, the contact surfaces 72A of the pads 61 to 65 have lengths longer than those of the nozzle-formed surface 39 in the longitudinal direction and the transverse direction of the nozzle-formed surface 39. Hence, in the wetting operation, the entire nozzle-formed surface 39 is pressed against the contact surface 72A, and thereby the entire nozzle-formed surface 39 is wetted. Further, the nozzle-formed surfaces 39 are pushed against the contact surfaces 72A, and thereby the pads 61 to 65 surround and are brought into contact with the side surfaces 36 of the ejecting heads 31 to 35. In this manner, the attached matter such as ink attached to the side surfaces 36 of the ejecting heads 31 to 35 is removed by being absorbed to the pads 61 to 65 or being attached to the pads 61 to 65.

As described above, since the attached matter such as the ink attached to the side surfaces 36 of the ejecting heads 31 to 35 is removed, an occurrence of stains on the continuous paper P due to the dropping of the attached matter to the continuous paper P is reduced.

In addition, in the exemplary embodiment, the pads 61 to 65 includes the cloth member 72 and the porous member 74, and the cloth members 72 are brought into contact with the nozzle-formed surfaces 39 of the ejecting heads 31 to 35. As described above, contact portions (cloth members 72) of the pads 61 to 65, with which the nozzle-formed surfaces 39 come into contact, are configured to be a separate member from a non-contact portion (porous member 74) in which contact does not occur, and thereby the contact portion has a function (for example, a dust producing property or holding force of the cleaning liquid L) which is different from that of the non-contact portion. Hence, the cloth member 72 having the dust producing property which is lower than that of the porous member 74 is used, and thereby dirt is unlikely to be attached to the nozzle-formed surfaces 39 and the occurrence of stains on the nozzle-formed surfaces 39 is reduced, compared to a configuration in which the pads 61 to 65 are formed of only the porous member 74.

In addition, in the exemplary embodiment, the pads 61 to 65 bulge upward to have a convex shape at the central portion in the transverse direction in an upper portion projecting upward from the accommodating member 76. In this manner, a contact defect of the pads 61 to 65 with the nozzle-formed surface 39 at the central portion in the transverse direction is reduced, compared to a configuration in which the pads 61 to 65 are formed to be flat in the transverse direction.

In addition, in the exemplary embodiment, the pushing amount of the ejecting heads 31 to 35 against the pads 61 to 65 changes, and thus the contact range of the pads 61 to 65 with the ejecting heads 31 to 35 change. Therefore, for example, it is possible to adjust the contact ranges of the contact range (refer to FIG. 18A) in which the pads 61 to 65 are brought into contact with the nozzle-formed surfaces 39 of the ejecting heads 31 to 35 and the contact range (refer to FIG. 11B) in which the pads 61 to 65 are brought into contact with the nozzle-formed surfaces 39 and the side surfaces 36 of the ejecting heads 31 to 35. Further, it is possible to adjust the wetting range of the ejecting heads 31 to 35 with the cleaning Liquid L. In other words, for example, it is possible to adjust the wetting ranges in the case where the pads 61 to 65 are brought into contact with the entire nozzle-formed surfaces 39 (refer to FIG. 18A) and in the case where the pads 61 to 65 are brought into contact with a part of the nozzle-formed surfaces 39 (refer to FIG. 18B).

In addition, in the exemplary embodiment, in a state in which the ejecting unit 30 is positioned at the wetting position (refer to FIG. 7), the height of the liquid level in the storage unit 14 with respect to the nozzle-formed surface 39 is higher than the height at the image forming position (refer to FIG. 8). In other words, an ink back pressure applied to supply the ink to the ejecting heads 31 to 35 is higher during the wetting operation than during the image forming operation.

Therefore, regardless of the position of the ejecting unit 30, an occurrence of absorbing ink and foreign matter from the nozzles 38 of the nozzle-formed surface 39 in the wetting operation is reduced, compared to a configuration in which the ink back pressure is constant all the time.

In addition, in the exemplary embodiment, the cleaning-liquid supply mechanism 80 supplies the cleaning liquid L to the contact surfaces 72A of the pads 61 to 65 in a dropping manner. Therefore, a high thinning effect of the ink attached on the contact surfaces 72A of the pads 61 to 65 is achieved, compared to a configuration in which the cleaning-liquid supply mechanism 80 supplies a liquid inside the pads 61 to 65. In this manner, an occurrence of thickening or solidifying of ink on the contact surfaces 72A of the pads 61 to 65 is reduced.

In addition, in the exemplary embodiment, in the cleaning-liquid supply mechanism 80, it is possible to change the supply amount of the cleaning liquid L to the pads 61 to 65. In this manner, it is possible to supply, to the pads 61 to 65, an amount of the cleaning liquid L depending on the stains on the pads 61 to 65.

In addition, in the exemplary embodiment, while the pads 61 to 65 are caused to move, the cleaning-liquid supply mechanism 80 supplies the cleaning liquid L. Therefore, the cleaning liquid L runs over the entire pads 61 to 65 with a small amount of the cleaning liquid L, compared to a configuration in which the pads 61 to 65 are fixed.

In addition, in the exemplary embodiment, the blade 83 of the cleaning-liquid supply mechanism 80 is disposed between the supply heads 81 and 82 and the ejecting unit 30 in the transport direction A (horizontal direction) of the continuous paper P. Therefore, even in a case where the cleaning liquid L supplied to the pads 61 to 65 from the supply heads 81 and 82 disperses, the cleaning liquid L reaches the blade 83 such that an amount of cleaning liquid dispersing to the ejecting unit 30 side is reduced. In other words, in the configuration, the cleaning liquid L supplied by the supply heads 81 and 82 to the pads 61 to 65 less disperses to the ejecting unit 30 side, compared to a configuration in which the blade 83 is disposed on a side opposite to the ejecting unit 30 side with respect to the supply heads 81 and 82.

(Modification Examples of Pads 61 to 65)

Figure 19A:
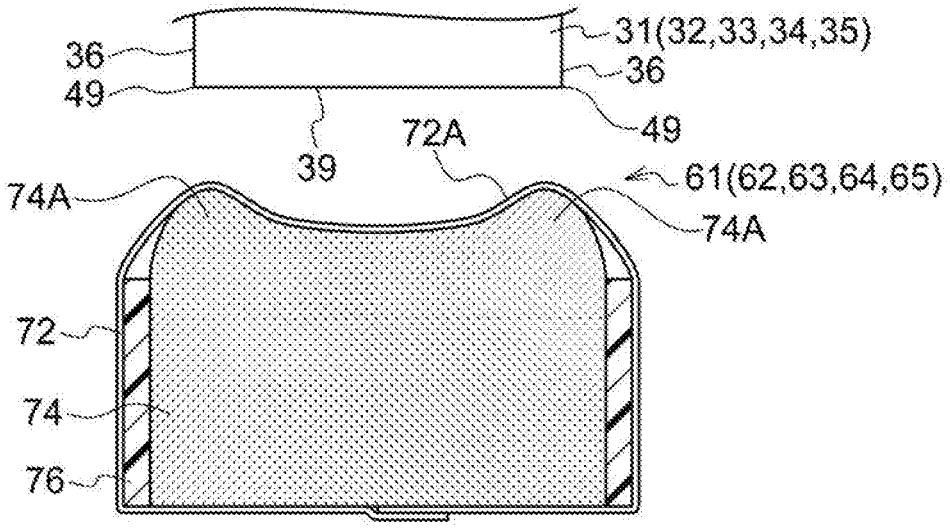
FIGS. 19A and 19B are sectional front views illustrating a configuration of a pad according to a modification example.
Figure 20:
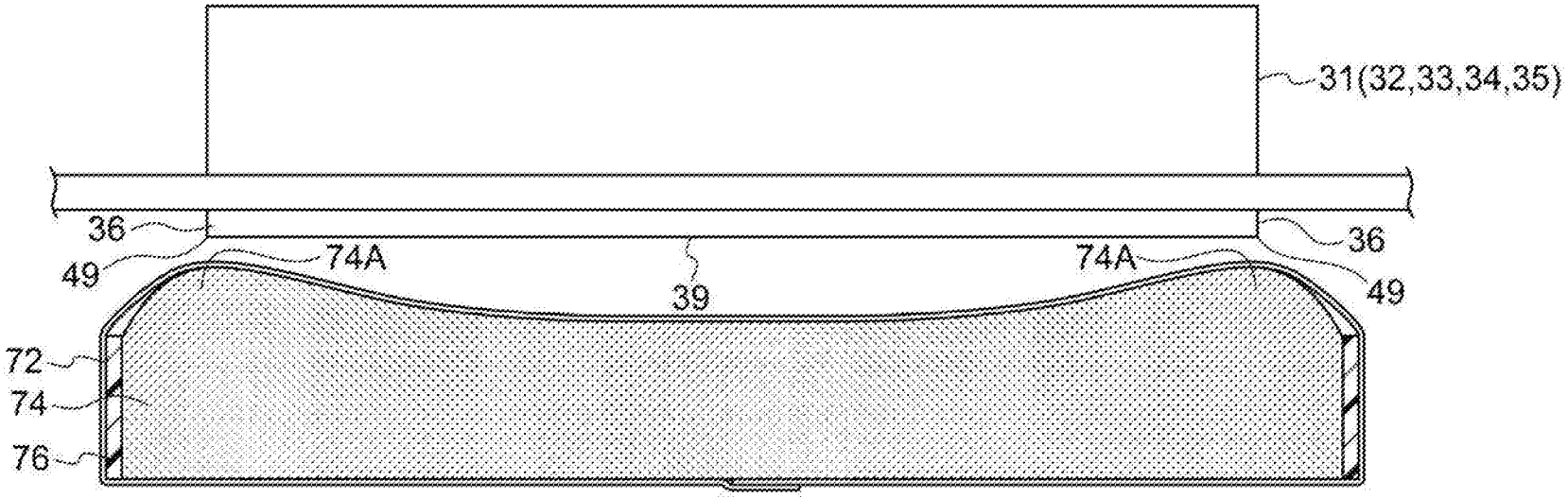
FIG. 20 is a sectional side view illustrating the configuration of the pad according to the modification example.

As illustrated in FIGS. 19A and 20, the pads 61 to 65 may bulge to have a convex shape in a portion with which an angled portion 49 formed of the nozzle-formed surface 39 and the side surface 36 of the ejecting unit 30 comes into contact with. Specifically, the pads 61 to 65 have a convex portion 74A projecting to have a convex shape in a view in the longitudinal direction and a view in the transverse direction toward the angled portion 49, and the convex portion is formed of the porous member 74. In other words, the convex portion 74A is formed to have a frame shape and faces the angled portion 49 (refer to FIG. 3) to have a rectangular shape (frame shape) in a bottom view. In this manner, the pads 61 to 65 bulge to have the convex shape in the portion with which the angled portion 49 of the ejecting unit 30 comes into contact with.

Figure 19B:
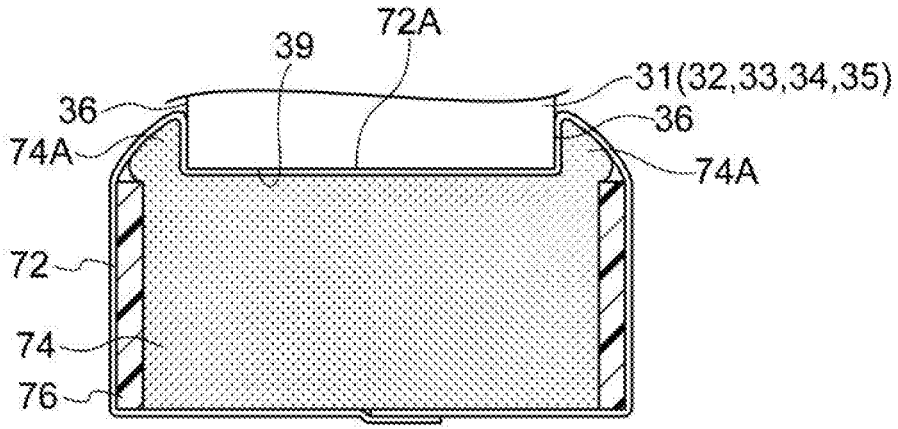

In the configuration, as illustrated in FIG. 19B, the nozzle-formed surfaces 39 are pushed against the contact surfaces 72A, and thereby the convex portions of the pads 61 to 65 surround and are brought into contact with the side surfaces 36 of the ejecting heads 31 to 35. In this manner, a high removing effect of the attached matter such as ink attached to the side surfaces 36 of the ejecting heads 31 to 35 is achieved, compared to a configuration in which the pads 61 to 65 are formed to be flat in the transverse direction.

In addition, in the configuration, the convex portions of the pads 61 to 65 are more compressed than the other portion. In this manner, since the absorbing force of the ink increases, it is possible to effectively remove the ink attached to the side surfaces 36 of the ejecting heads 31 to 35.

In addition, in the exemplary embodiment, the pads 61 to 65 bulge upward to have a convex shape at the central portion in the transverse direction and are formed to have a hog-backed shape; however, the shape of the pad is not limited thereto.

Figure 21A:
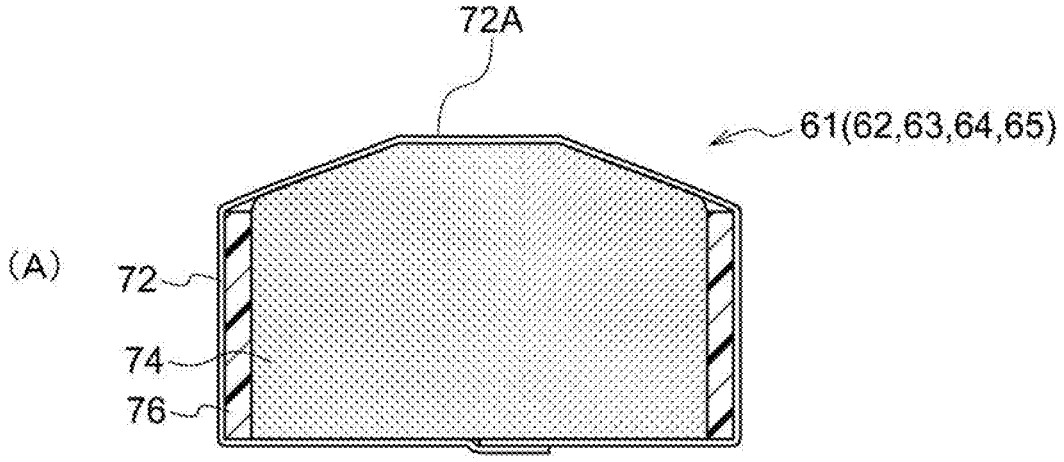
FIGS. 21A and 21B are sectional front views illustrating a configuration of a pad according to another modification example.
Figure 21B:
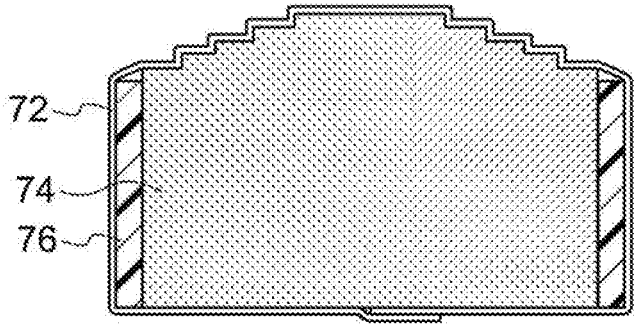

For example, as illustrated in FIG. 21A, the pads 61 to 65 may be configured to be formed to have an upper portion that has a trapezoidal shape in a sectional front view. Further, as illustrated in FIG. 21B, a hypotenuse of the trapezoidal, shape in FIG. 21A may be formed to have a stepped shape. In the configuration, the pushing amount of the ejecting heads 31 to 35 against the pads 61 to 65 change, and thereby, for example, it is possible to adjust the wetting range of the ejecting heads 31 to 35 with the cleaning liquid L. In other words, for example, it is possible to adjust the wetting ranges in the case where the pads 61 to 65 wet the entire nozzle-formed surfaces 39 (refer to FIG. 18A) and in the case where the pads 61 to 65 wet a part of the nozzle-formed surfaces 39 (refer to FIG. 18B).

(Other Modification Examples)

In the exemplary embodiment, the pads 61 to 65 are configured to be impregnated with the ink as an example of the liquid and a cleaning liquid; however, the configuration is not limited thereto. A configuration of using only one of the ink or the cleaning liquid as an example of the liquid may employed.

In the exemplary embodiment, the pads 61 to 65 are provided inside the cap member 66 that performs the capping operation; however, the configuration is not limited thereto. The pads 61 to 65 may be configured to be provided on dedicated members to performing the wetting operation.

In the exemplary embodiment, the wipers 51 and 52 are used as an example of the wiping member; however, the configuration is not limited thereto, and a cloth member such as a web may be used.

The invention is not limited to the exemplary embodiments described above, and it is possible to perform various alterations, modifications, or improvements within a range without departing from a gist thereof. For example, the modification examples described above may have a configuration in which plural modification examples are appropriately combined.

What is claimed is:

1. A wiping device comprising:

an impregnated member that is impregnated with a liquid, has a contact surface having a first length and a second length, the first length being longer than a length of a nozzle-formed surface of an ejecting head in a longitudinal direction, the second length being longer than a length of the nozzle-formed surface in a transverse direction intersecting with the longitudinal direction, the ejecting head configured to eject an ejection liquid, the contact surface configured to contact with the nozzle-formed surface to wet the nozzle-formed surface; and a wiping member configured to wipe the nozzle-formed surface wetted by the impregnated member;

wherein the impregnated member has a cloth member with a front surface that configures the contact surface and a porous member disposed on the backside of the cloth member.

2. The wiping device according to claim 1, wherein the impregnated member bulges out convexly at the central portion in the transverse direction.

3. A wiping device comprising:

an impregnated member that is impregnated with a liquid, has a contact surface having a first length and a second length, the first length being longer than a length of a nozzle-formed surface of an ejecting head in a longitudinal direction, the second length being longer than a length of the nozzle-formed surface in a transverse direction intersecting with the longitudinal direction, the ejecting head configured to eject an ejection liquid, the contact surface configured to contact with the nozzle-formed surface to wet the nozzle-formed surface; and a wiping member configured to wipe the nozzle-formed surface wetted by the impregnated member;

wherein the impregnated member only bulges out convexly in portions at both ends of the impregnated member in the transverse direction, the bulged out portions of the impregnated member coming into contact with an angled portion formed between the nozzle-formed surface and a side surface of the ejecting head.

4. The wiping device according to claim 2, wherein a pushing amount of the ejecting head against the impregnated member changes, and thus it is possible to change a contact range of the impregnated member with respect to the ejecting head.

5. The wiping device according to claim 1, further comprising:

a supply unit that supplies the liquid by dripping the liquid to the contact surface of the impregnated member, wherein the liquid can redissolve a thickened or solidified ejection liquid.

6. The wiping device according to claim 5, wherein the supply unit is capable of changing a supply amount of the liquid to the impregnated member.

7. The wiping device according to claim 5, wherein the supply unit supplies the liquid while the impregnated member is actuated to move.

8. The wiping device according to claim 5, further comprising:

a wiping member for the impregnated member which is disposed between the supply unit and the ejecting head and wipes the impregnated member.

9. An ejecting device comprising:

an ejecting head that ejects an ejection liquid to a recording medium; and a wiping device including:

an impregnated member that is impregnated with a liquid, has a contact surface having a first length and a second length, the first length being longer than a length of a nozzle-formed surface of the ejecting head in a longitudinal direction, the second length being longer than a length of the nozzle-formed surface in a transverse direction intersecting with the longitudinal direction, the contact surface configured to contact with the nozzle-formed surface to wet the nozzle-formed surface; and a wiping member configured to wipe the nozzle-formed surface wetted by the impregnated member;

wherein back pressure used to supply the ejection liquid to the ejecting head is higher when the contact surface comes into contact with the nozzle-formed surface than when the ejection liquid is ejected from the ejecting head.

* * * * *